US007179169B2

(12) United States Patent
Beaulieu et al.

(10) Patent No.: US 7,179,169 B2
(45) Date of Patent: Feb. 20, 2007

(54) METHOD AND APPARATUS FOR DISPLAYING A SYMBOL ON A WHEEL ASSOCIATED WITH A GAMING APPARATUS

(75) Inventors: Nicole Beaulieu, Reno, NV (US); Robert Breckner, Sparks, NV (US)

(73) Assignee: IGT, Reno, NV (US)

( * ) Notice: Subject to any disclaimer, the term of this patent is extended or adjusted under 35 U.S.C. 154(b) by 690 days.

(21) Appl. No.: 10/377,465

(22) Filed: Feb. 28, 2003

(65) Prior Publication Data

US 2004/0171417 A1 Sep. 2, 2004

(51) Int. Cl.
*A63F 9/24* (2006.01)

(52) U.S. Cl. ..... 463/25; 463/20; 463/30

(58) Field of Classification Search ..... 463/12–13, 463/16–20, 25–27, 30, 40–42; 273/292–293, 273/143 R, 236, 237, 269
See application file for complete search history.

(56) References Cited

U.S. PATENT DOCUMENTS

| | | | | |
|---|---|---|---|---|
| 4,711,451 | A | 12/1987 | Pajak et al. | 273/143 R |
| 5,188,363 | A | 2/1993 | Marnell, II et al. | 273/85 |
| 5,362,052 | A | 11/1994 | Kubatsch | 273/145 R |
| 5,823,874 | A * | 10/1998 | Adams | 463/17 |
| 6,224,483 | B1 | 5/2001 | Mayeroff | 463/20 |
| 6,319,124 | B1 | 11/2001 | Baerlocher et al. | 463/20 |
| 6,461,241 | B1 | 10/2002 | Webb et al. | 463/20 |
| 6,491,296 | B2 | 12/2002 | Kelly et al. | 273/118 A |
| 6,517,437 | B1 | 2/2003 | Wells et al. | 463/30 |
| 6,554,703 | B1 | 4/2003 | Bussick et al. | 463/20 |
| 6,558,254 | B2 | 5/2003 | Baelocher et al. | 463/20 |
| 6,561,512 | B2 | 5/2003 | Luciano et al. | 273/142 |
| 6,561,900 | B1 | 5/2003 | Baerlocher et al. | 463/20 |
| 6,565,433 | B1 | 5/2003 | Baerlocher et al. | 463/20 |
| 7,011,581 | B2 * | 3/2006 | Cole et al. | 463/16 |

* cited by examiner

*Primary Examiner*—Mark Sager
(74) *Attorney, Agent, or Firm*—Marshall, Gerstein & Borun LLP

(57) ABSTRACT

A gaming apparatus that comprises a display unit that is capable of generating video images, a value input device, and a controller operatively coupled to the display unit and the value input device. The controller comprises a processor and a memory that are operatively coupled to the processor. The controller is programmed to allow a person to make a wager, and to cause a display portion representing an image of a rotating wheel to be generated on the display unit, wherein the rotating wheel has a section with a symbol displayed thereon. The controller is programmed to cause the symbol image to be displayed in a first orientation relative to the wheel when the wheel lies in a first angular orientation and to cause the symbol image to be adjusted so that the symbol image is displayed in a second orientation that is angularly spaced from the first angular orientation. The controller is also programmed to determine a value payout associated with an outcome of a game incorporating the wheel.

35 Claims, 17 Drawing Sheets

FIG. 17
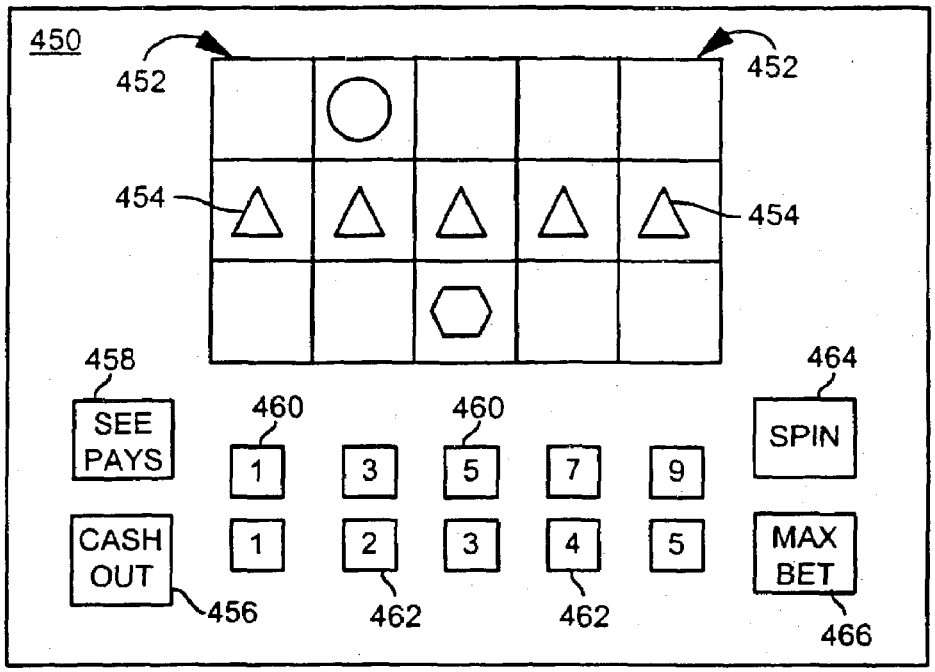
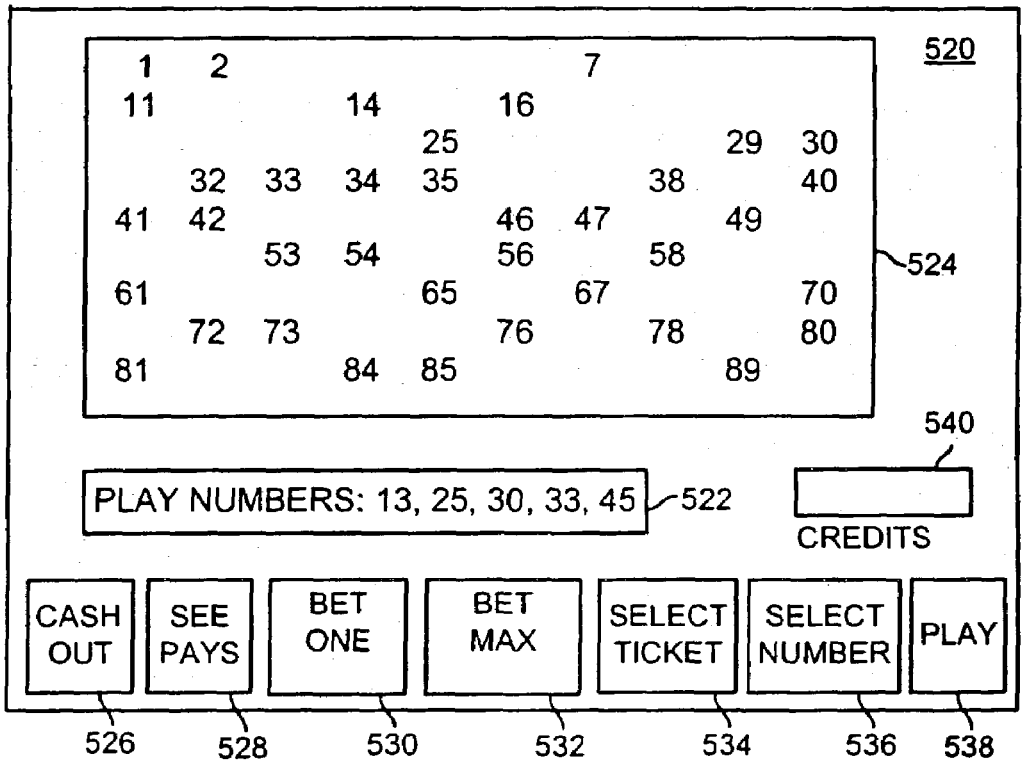
FIG. 18

METHOD AND APPARATUS FOR DISPLAYING A SYMBOL ON A WHEEL ASSOCIATED WITH A GAMING APPARATUS

BACKGROUND

Gaming machines have long been a significant facet of the gaming industry. One of the most basic implementations of a gaming machine is an electromechanical device employing either a mechanically rotatable wheel or a video image of a rotating wheel. One example of such a gaming machine is disclosed in U.S. Pat. No. 5,823,874 which discloses a gaming machine comprising a plurality of reels (i.e., wheels), each of which have a plurality of symbols on their periphery. The reels independently spin and ultimately stop to display a random combination of the symbols. If the display contains one of a preselected plurality of winning combinations, the machine will determine a value payout corresponding to the combination of symbols displayed.

Another example of such a gaming machine is disclosed in U.S. Pat. No. 6,334,814 which discloses a gaming machine comprising both a primary game using a plurality of reels, each of which have a plurality of symbols displayed on their periphery, as well as a bonus indicator in the form of a rotatable wheel. The disclosed bonus wheel is a carnival-type wheel that is motor driven and linked to a random value generator to randomly determine where the wheel will stop. The bonus wheel is further linked to a controller to gradually reduce the rate of spin prior to stopping in order to simulate a mechanical spinning wheel.

SUMMARY

The present patent is directed to a gaming apparatus with a display unit that is capable of generating video images, a value input device, and a controller that is operatively coupled to the display unit and the value input device. The controller includes a processor and a memory that are operatively coupled to the processor The controller is programmed to allow a person to make a wager and to cause a display portion representing an image of a rotating wheel to be generated on the display unit. The rotating wheel image has a section with a symbol image displayed thereon.

The controller is also programmed to cause the symbol image to be displayed in a first orientation relative to the rotating wheel image when the rotating wheel image lies in a first angular orientation and to cause the symbol image to be adjusted so that the symbol image is displayed in a second orientation angularly spaced from the first angular orientation Further, the controller is programmed to determine a value payout associated with an outcome of a game incorporating the wheel image.

The controller may also be programmed to cause the symbol image to be adjusted after the rotating wheel image rotates about an axis by a predetermined degree of rotation. Additionally, the controller may be further programmed to determine a value payout based on a resting position of said wheel image after said wheel image has stopped rotating. Furthermore, the controller may be programmed to cause a plurality of symbol images to be displayed on the section, wherein the plurality of symbol images represent a prize that may be won by the player. The symbol images may then be updated by the controller to represent a current prize.

In another aspect of the invention, a gaming apparatus is provided that includes a value input device, a mechanically rotatable wheel divided into a plurality of sections, at least one of the sections comprising an electronic display. Also included is a controller operatively coupled to the mechanically rotatable wheel, the value input device, and the electronic display. The controller includes a processor and a memory operatively coupled to the processor.

The controller is programmed to: allow a person to make a wager; cause a symbol image to be generated on the electronic display; cause the symbol image to be displayed in a first orientation relative to the mechanically rotatable wheel when the mechanically rotatable wheel lies in a first angular orientation and to cause the symbol image to be adjusted so that the symbol image is displayed in a second orientation angularly spaced from the first angular orientation, and determine a value payout associated with an outcome of a game incorporating the mechanically rotatable wheel.

Additional aspects of the invention are defined by the claims of this patent.

BRIEF DESCRIPTION OF THE DRAWINGS

FIG. 17 is an illustration of an embodiment of a visual display that may be displayed during performance of the slots routine of FIG. 12;

FIG. 18 is an illustration of an embodiment of a visual display that may be displayed during performance of the video keno routine of FIG. 13;

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
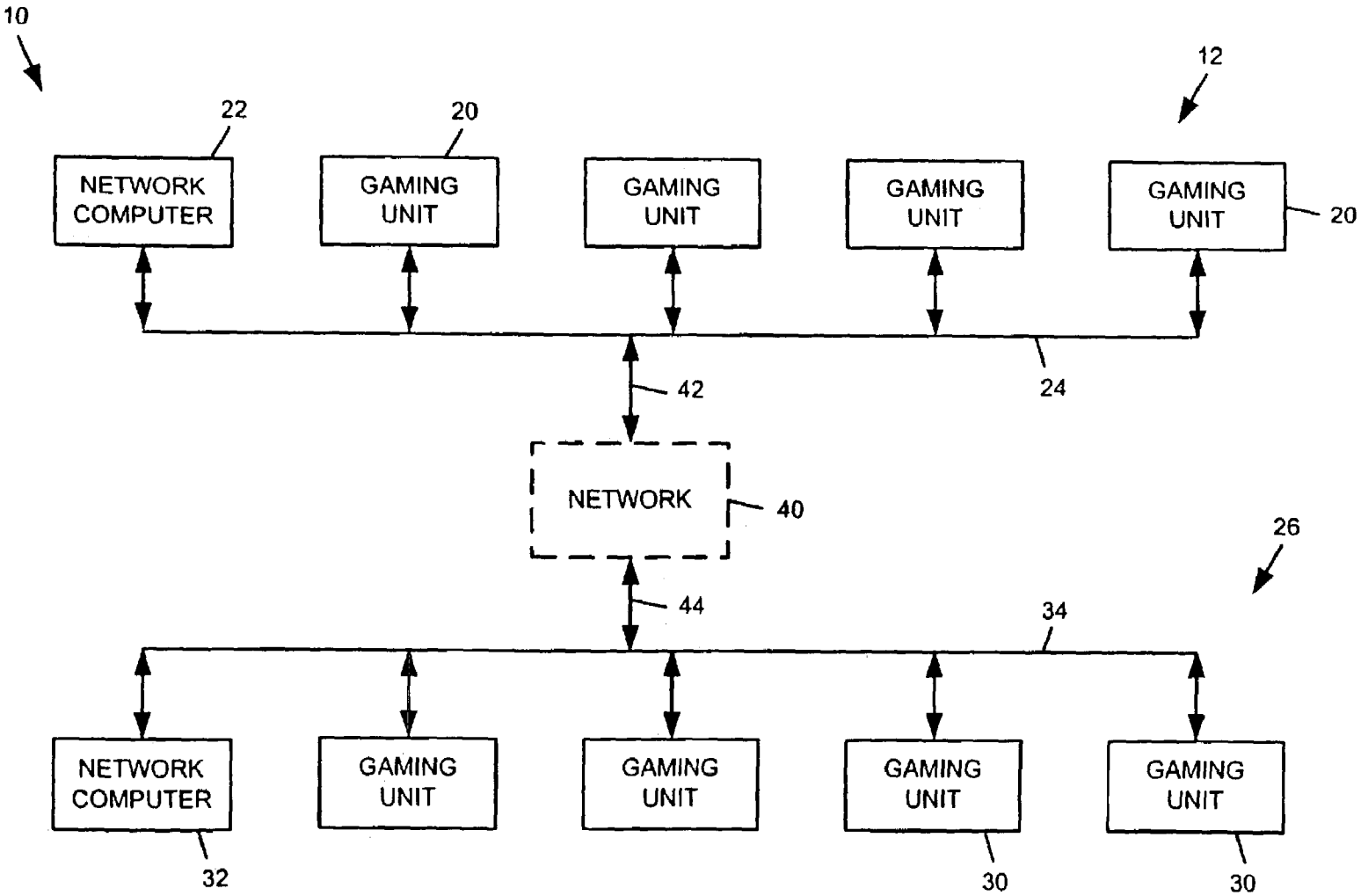
FIG. 1 is a block diagram of an embodiment of a gaming system in accordance with the invention.

FIG. 1 illustrates one possible embodiment of a casino gaming system 10 in accordance with the invention. Referring to FIG. 1, the casino gaming system 10 may include a first group or network 12 of casino gaming units 20 operatively coupled to a network computer 22 via a network data link or bus 24. The casino gaming system 10 may include a second group or network 26 of casino gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a local area network (LAN) via a first network link 42 and a second network link 44.

The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. The network 40 may include a plurality of network computers or server computers (not shown), each of which may be operatively interconnected. Where the network 40 comprises the Internet, data communication may take place over the communication links 42, 44 via an Internet communication protocol.

The network computer 22 may be a server computer and may be used to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits of players playing each of the gaming units 20, etc. The network computer 32 may be a server computer and may be used to perform the same or different functions in relation to the gaming units 30 as the network computer 22 described above. It should also be noted that the gaming units 20 may also be configured servers.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may provided as a dedicated hardwired link or a wireless link. Although the data link 24 is shown as a single data link 24, the data link 24 may comprise multiple data links. It should also be noted that the network computers 22, 32 may be eliminated and the gaming units 20, 30 may each be their own server.

Figure 2:
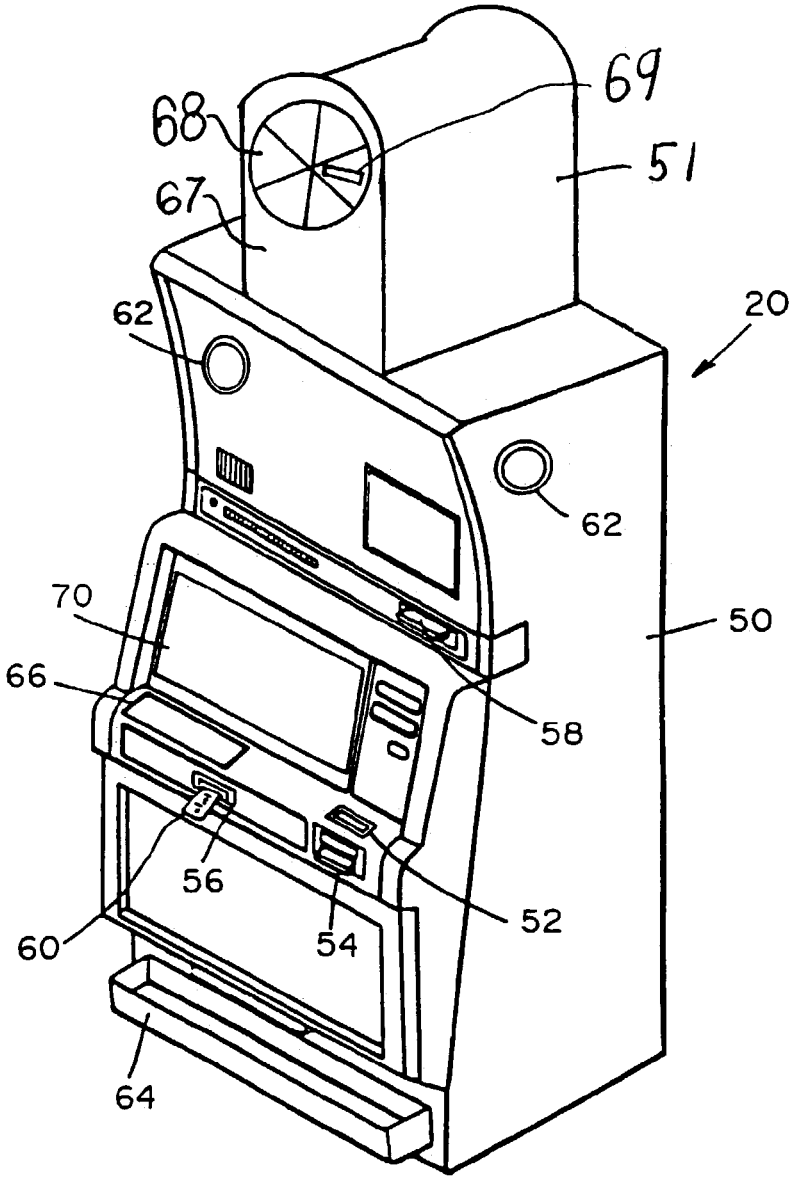
FIG. 2 is a perspective view of an embodiment of one of the gaming units shown schematically in FIG. 1.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of casino gaming unit and may have various different structures and methods of operation. For exemplary purposes, various designs of the gaming units 20 are described below, but it should be understood that numerous other designs may be utilized.

Referring to FIG. 2, the casino gaming unit 20 may include a housing or cabinet 50, a wheel housing 51, and one or more input devices, which may include a coin slot or acceptor 52, a paper currency acceptor 54, a ticket reader/printer 56 and a card reader 58, which may be used to input value to the gaming unit 20. A value input device may include any device that can accept value from a customer. As used herein, the term "value" may encompass gaming tokens, coins, paper currency, ticket vouchers, credit or debit cards, smart cards, and any other object representative of value.

If provided on the gaming unit 20, the ticket reader/printer 56 may be used to read and/or print or otherwise encode ticket vouchers 60. The ticket vouchers 60 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader 58 may include any type of card reading device, such as a magnetic card reader or an optical card reader, and may be used to read data from a card offered by a player, such as a credit card or a player tracking card. If provided for player tracking purposes, the card reader 58 may be used to read data from, and/or write data to, player tracking cards that are capable of storing data representing the identity of a player, the identity of a casino, the player's gaming habits, etc.

The gaming unit 20 may include one or more audio speakers 62, a coin payout tray 64, and an input control panel 66. The audio speakers 62 may generate audio representing sounds such as the noise of spinning slot machine reels, a dealer's voice, music, announcements or any other audio related to a casino game. The input control panel 66 may be provided with a plurality of pushbuttons or touch-sensitive areas that may be pressed by a player to select games, make wagers, make gaming decisions, etc. The wheel housing 51 may have a transparent display portion 67 associated therewith. The wheel housing 51 may enclose a mechanical wheel 68 that is divided into a plurality of sections or slices. An electronic display 69 may be attached to the wheel 68 and operatively coupled to a controller to display one or more symbols on the display 69. The wheel 68 may be positioned within the wheel housing 51 so that a front surface of the wheel and the images or symbols displayed on the electronic display 69 are visible to a player through the transparent display portion 67. While only one section of the wheel 68 has an electronic display 69 attached thereto, it should be noted that a plurality of electronic displays may be attached to the wheel. For example, each of the sections may have an electronic display attached to it.

The electronic display 69 may be used to display, for example, one or more symbols, such as characters, that represent, for example, a monetary value available as a prize, a generic word such as "JACKPOT," or the name of a dynamic prize such as "HARLEY" or "DIAMOND RING." The symbols may be periodically adjusted so they remain logically legible to a player playing the gaiming unit 20. If the spinning wheel stops on a slice that has an electronic display attached to it, the player may be awarded the dynamic prize currently indicated on the electronic display. The rotating wheel may be part of a primary game played on the gaming apparatus or it may be used as a special bonus game for more standard games, such as poker, blackjack, slots, keno, bingo, pachinko, etc.

The gaming unit 20 may also include a color video display unit 70 for displaying images relating to the game or games provided by the gaming unit 20. These games include games that incorporate a spinning wheel. Those skilled in the art will appreciate that the mechanical wheel 68 and electronic display 69 may be replaced with a second video display unit, similar to the video display unit 70, to display video images of a spinning wheel having symbols displayed thereon. Alternatively, the gaming unit 20 may have only a single video display unit 70 that is used to display images of the spinning wheel and symbols. Additionally, the gaming unit 20 may have only a single mechanical wheel in place of the video display unit 70. In summary, the claims of this patent are intended to cover all combinations of video display units and mechanical wheels.

Figure 2A:
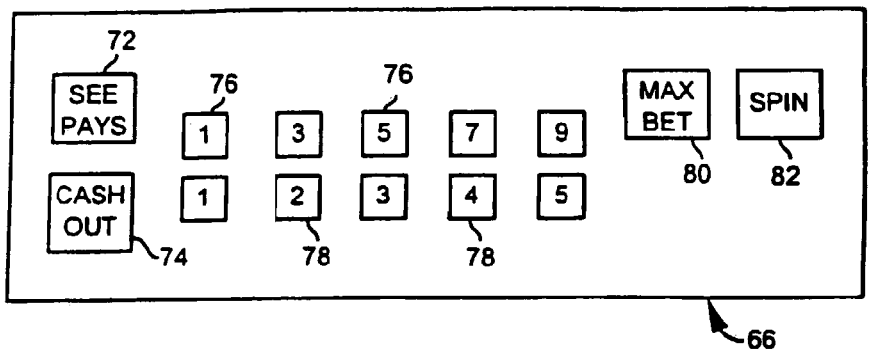
FIG. 2A illustrates an embodiment of a control panel for a gaming unit.

FIG. 2A illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the display unit 70 to generate one or more display screens showing the odds or payout information for the game or games provided by the gaming unit 20. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as by returning a number of coins to the player via the payout tray 64.

If the gaming unit 20 provides a slots game having a plurality of reels and a plurality of paylines which define winning combinations of reel symbols, the control panel 66 may be provided with a plurality of selection buttons 76, each of which allows the player to select a different number of paylines prior to spinning the reels. For example, five buttons 76 may be provided, each of which may allow a player to select one, three, five, seven or nine paylines.

If the gaming unit 20 provides a slots game having a plurality of reels, the control panel 66 may be provided with a plurality of selection buttons 78 each of which allows a player to specify a wager amount for each payline selected. For example, if the smallest wager accepted by the gaming unit 20 is a quarter ($0.25), the gaming unit 20 may be provided with five selection buttons 78, each of which may allow a player to select one, two, three, four or five quarters to wager for each payline selected. In that case, if a player were to activate the "5" button 76 (meaning that five paylines were to be played on the next spin of the reels) and then activate the "3" button 78 (meaning that three coins per payline were to be wagered), the total wager would be $3.75 (assuming the minimum bet was $0.25).

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. The control panel 66 may include a spin button 82 to allow the player to initiate spinning of the reels of a slots game after a wager has been made.

In FIG. 2A, a rectangle is shown around the buttons 72, 74, 76, 78, 80, 82. It should be understood that that rectangle simply designates, for ease of reference, an area in which the buttons 72, 74, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen.

Gaming Unit Electronics

Figure 3:
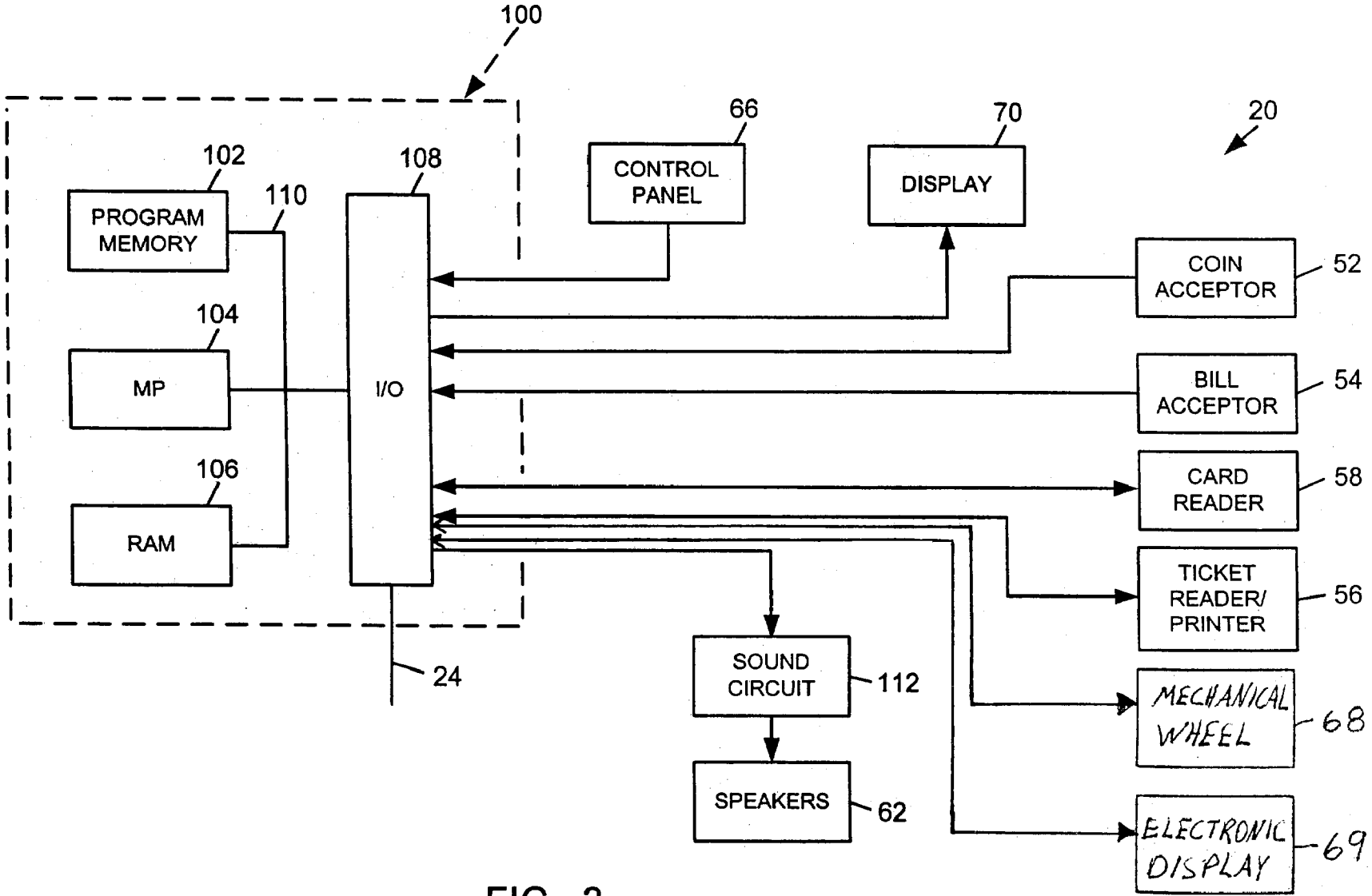
FIG. 3 is a block diagram of the electronic components of the gaming unit of FIG. 2.

FIG. 3 is a block diagram of a number of components that may be incorporated in the gaming unit 20. Referring to FIG. 3, the gaming unit 20 may include a controller 100 that may comprise a program memory 102, a microcontroller or microprocessor (MP) 104, a random-access memory (RAM) 106 and an input/output (I/O) circuit 108, all of which may be interconnected via an address/data bus 110. It should be appreciated that although only one microprocessor 104 is shown, the controller 100 may include multiple microprocessors 104. Similarly, the memory of the controller 100 may include multiple RAMs 106 and multiple program memories 102. Although the I/O circuit 108 is shown as a single block, it should be appreciated that the I/O circuit 108 may include a number of different types of I/O circuits. The RAM(s) 104 and program memories 102 may be implemented as semiconductor memories, magnetically readable memories, and/or optically readable memories, for example.

Although the program memory 102 is shown in FIG. 3 as a read-only memory (ROM) 102, the program memory of the controller 100 may be a read/write or alterable memory, such as a hard disk. In the event a hard disk is used as a program memory, the address/data bus 110 shown schematically in FIG. 3 may comprise multiple address/data buses, which may be of different types, and there may be an I/O circuit disposed between the address/data buses.

FIG. 3 illustrates that the control panel 66, the coin acceptor 52, the bill acceptor 54, the card reader 58 and the ticket reader/printer 56 may be operatively coupled to the I/O circuit 108, each of those components being so coupled by either a unidirectional or bidirectional, single-line or multiple-line data link, which may depend on the design of the component that is used. The speaker(s) 62 may be operatively coupled to a sound circuit 112, that may comprise a voice- and sound-synthesis circuit or that may comprise a driver circuit. The sound-generating circuit 112 may be coupled to the I/O circuit 108.

As shown in FIG. 3, the components 52, 54, 56, 58, 66, 68, 69, 112 may be connected to the I/O circuit 108 via a respective direct line or conductor. Different connection schemes could be used. For example, one or more of the components shown in FIG. 3 may be connected to the I/O circuit 108 via a common bus or other data link that is shared by a number of components. Furthermore, some of the components may be directly connected to the microprocessor 104 without passing through the I/O circuit 108.

Figure 4:
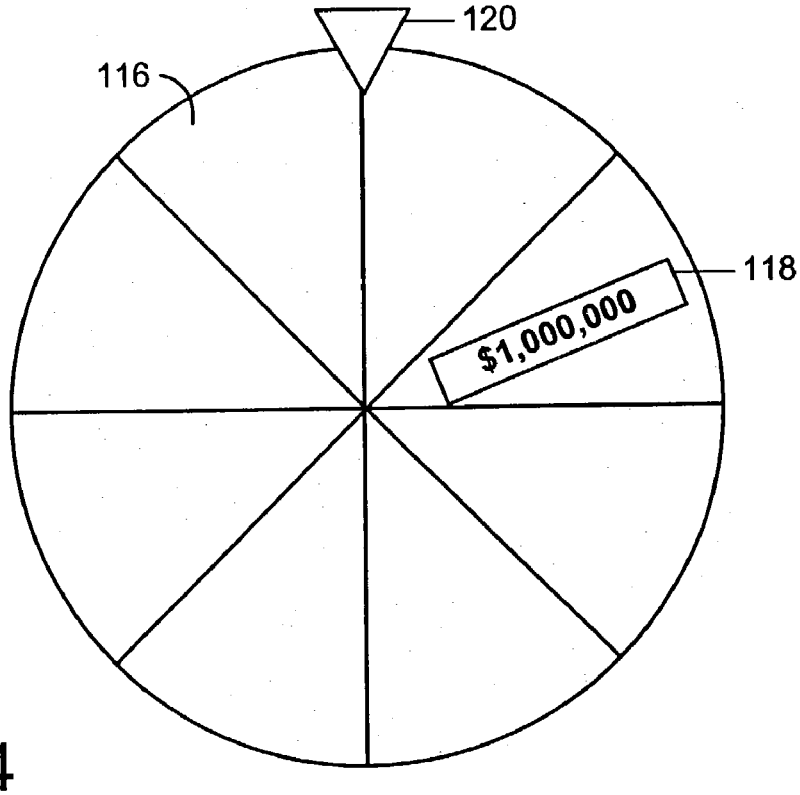
FIG. 4 illustrates an embodiment of a wheel having an electronic display disposed in a first position.
Figure 5:
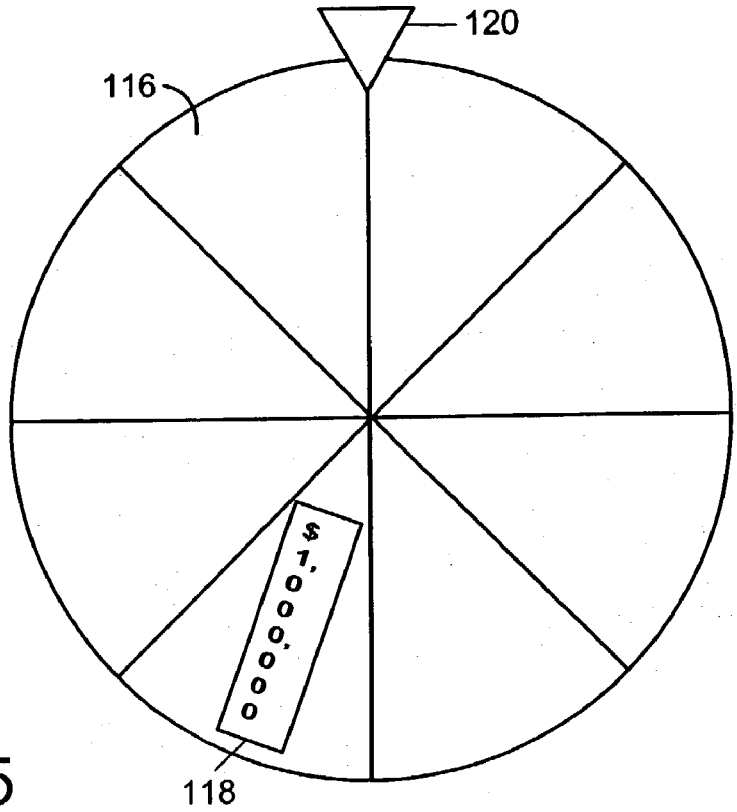
FIG. 5 illustrates another embodiment of a wheel having an embedded electronic display disposed in a second position.
Figure 6:
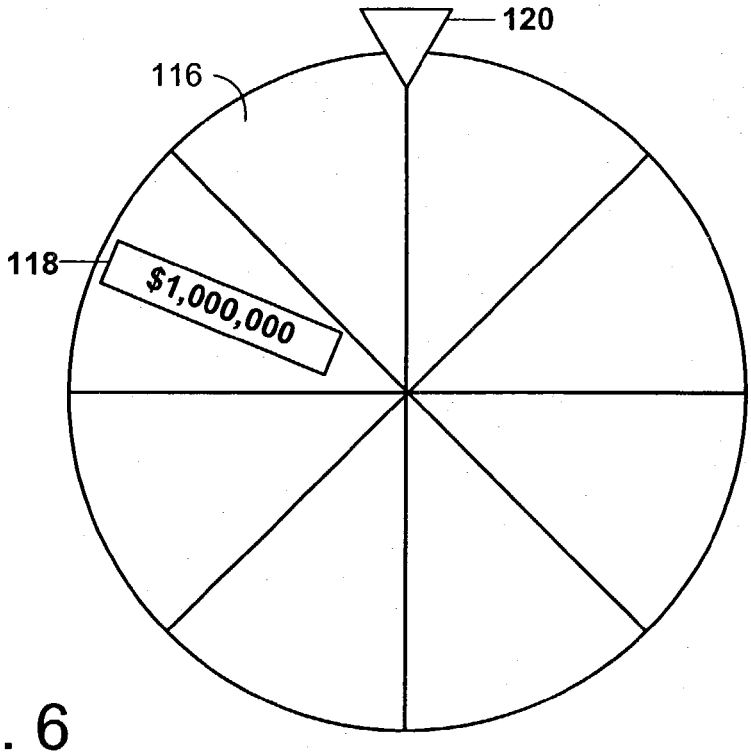
FIG. 6 illustrates another embodiment of a wheel having an electronic display disposed in a third position.

FIGS. 4–6 illustrate three positions of an exemplary wheel 116, wherein the wheel 116 is divided into a plurality of sections and has an electronic display 118 attached to the wheel 116 and positioned on one of the sections. The electronic display 118 may be any display known to those skilled in the art. For example, the electronic display 118 could be a text-capable spectrum display. The electronic display 118 may be embedded within the wheel 116 and may further be operatively coupled to the controller 100 to control the symbols displayed and their appropriate orientation with respect to a player. The wheel 116 also has an award pointer 120 that may be used to indicate the prize awarded to a player based on the section of the wheel 116 that stops behind the award pointer 120. Alternatively, the award pointer 120 could rotate around the wheel 116, wherein the prize awarded to the player would be determined based on where the award pointer 120 stops in relation to the wheel 116. While not shown, the wheel 116 may have a sensor, such as for example, an optical decoder, that is operatively coupled to the controller 100 to monitor the angular position of the wheel 116. The sensor may be used to determine what section of the wheel 116 stops adjacent the award pointer 120 when the wheel 116 stops spinning. The angular position of the wheel 116 directly corresponds to the section of the wheel that is adjacent to award pointer 120. It is also possible that multiple award pointers 120 could be used in conjunction with the wheel 116 and the electronic display 118.

In FIG. 4, the electronic display 118 is displaying a plurality of symbols in the form of characters that represent a jackpot value of $1,000,000, wherein the electronic display 118 is located in a first quadrant and angled at approximately 30 degrees. The symbols displaying the "$1,000,000" may be oriented on the electronic display 118 so that they are logically legible to a player. In other words, the symbols (characters here) may be oriented so that a player standing on the ground can easily read the characters and comprehend the value or prize that is being displayed on the electronic display 118. The characters in FIG. 4 may be aligned in a row so that they are read from left to right on the electronic display 118.

The controller 100 may be programmed to periodically adjust the orientation of the symbols as the wheel 116 rotates about the axis so that the symbols remain logically legible to the player. The frequency that the orientation of the symbols are updated may be varied. For example, the symbols may be adjusted hundreds of times during each revolution of the wheel 116. Another example could be to adjust the orientation of the symbols after each 90 degrees of rotation of the wheel 116. In other words, the orientation oft the symbols may be rotated 90 degrees in a first angular direction after the wheel 116 has rotated 90 degrees in an opposite angular direction. The controller 100 may also cause the wheel 116 to rotate to a known stop point without regard or concern for the actual number of degrees that the wheel 116 rotated.

It may be determined that adjustments of a limited frequency are sufficient because most players will still be able to easily read and comprehend symbols on the electronic display 118 that have been rotated slightly. As an example, the electronic display 118 could be oriented as shown in FIG. 4 for the period where the section of wheel 116 is between 45 degrees and 315 degrees, when the wheel 166 is rotating in a clock-wise direction. Once the section of the wheel having the electronic display 118 rotates past 315 degrees, the orientation of the symbols on the electronic display 118 could be adjusted so that they remain logically legible to the player (FIG. 5) by aligning in a vertical manner the characters representing the prize of "$1,000,000."

FIG. 5 illustrates the wheel 116 from FIG. 4 where the electronic display 118 is located in a third quadrant at approximately a 250 degree angle. The embodiment of FIG. 5 is similar to the embodiment shown in FIG. 4 and includes many of the same structures and components. For clarity, the structures and components remaining the same are shown with like reference numbers as those from FIG. 4. Referring to FIG. 5, the electronic display 118 displays the same prize of "$1,000,000" as what was displayed in FIG. 4, except that the symbols have been adjusted so that the individual characters are substantially vertically oriented and thus logically legible, and the plurality of characters are displayed as though they are stacked on top of each other, in order to fit on the rectangularly shaped electronic display 118. If the electronic display 118 were substantially square in shape, the stacking may not be necessary, as the adjusted characters could be aligned horizontally and read from left to right by the player. Also, stacking the symbols on the electronic display 118 may not be necessary if the size of the symbols is small in comparison to the size of the slices of the wheel 116. In any event, the individual symbols may be adjusted so that they are logically legible to the player.

Continuing with the example described above where only four adjustments are made per revolution of the wheel 116, the electronic display 118 could be oriented as shown in FIG. 5 for the period where the section of wheel is between 315 degrees and 225 degrees, when the wheel 116 is rotating in a clock-wise direction. Once the section of the wheel having the electronic display 118 rotates past 225 degrees, the orientation of the symbols on the electronic display 118 could be adjusted so that they remain logically legible to the player (FIG. 6) by reorienting each of the symbols so that they are more vertical in orientation, and positioning them in a substantially horizontal alignment. The symbols representing the prize of "$1,000,000" could then be read from left to right by the player.

FIG. 6 illustrates the exemplary wheel 116, shown in FIGS. 4 and 5, with the electronic display 118 located in a second quadrant at approximately a 155 degree angle. The embodiment of FIG. 6 is similar to the embodiments shown in FIGS. 4 and 5 and includes many of the same structures and components. For clarity, the structures and components remaining the same are shown with like reference numbers as those from FIGS. 4 and 5. Referring to FIG. 6, the electronic display 118 displays the same prize of "$1,000,000" that was displayed in FIGS. 4 and 5, except that the symbols have been adjusted so that the individual characters have again been reoriented so they are more vertically oriented to remain logically legible, and the plurality of characters are aligned in a substantially horizontal fashion so that they are read from left to right by the player.

Continuing with the example described above where only four adjustments are made per revolution of the wheel 116, the electronic display 118 could be oriented as shown in FIG. 6 for the period where the section of the wheel is between 225 degrees and 135 degrees, when the wheel 116 is rotating in a clock-wise direction. Once the section of the wheel having the electronic display 118 rotates past 135 degrees, the orientation of the symbols on the electronic display 118 could be adjusted so that they remain logically legible to the player by reorienting each of the symbols so that they are more vertical in orientation, and positioning them so they appear to be stacked on top of each other as shown in FIG. 5. The symbols representing the prize of "$1,000,000" could then be read from top-to-bottom by the player.

Those skilled in the art will appreciate that the specific degrees chosen in the example discussed in FIGS. 4–6 were arbitrary and any modifications to those degrees could easily be made. Furthermore, more frequent updates to the orientation of the symbols on the electronic display 118 could be performed to accomplish a more fluid reorientation of the symbols as the wheel 116 rotates. It should also be noted that while the symbols shown in FIGS. 4–6 are characters, other symbols may be displayed, such as, for example, electronic pictures of rings, cars, boats, trips, etc.

In addition to updating the orientation of the symbols, the symbols themselves may be dynamically updated. For example, the symbols may be dynamically updated to reflect a current amount of a jackpot prize or to reflect a current prize available to be won by a player (e.g. 'CAR,' 'DIAMOND RING,' etc.). This concept could also be used in conjunction with a progressive jackpot, where the value of the progressive jackpot is displayed on a slice of the wheel 116. Those skilled in the art will also appreciate that the wheel 116, the electronic display 118, and the award pointer 120 may be replaced by a video display unit operatively coupled to the controller 100 to generate a video image of the wheel 116, electronic display 118 and award pointer 120. If these components are replaced with video images, the controller 100 may also update the orientation of the symbols on the wheel as the wheel rotates, so that the symbols remain logically legible to the player.

Figure 7:
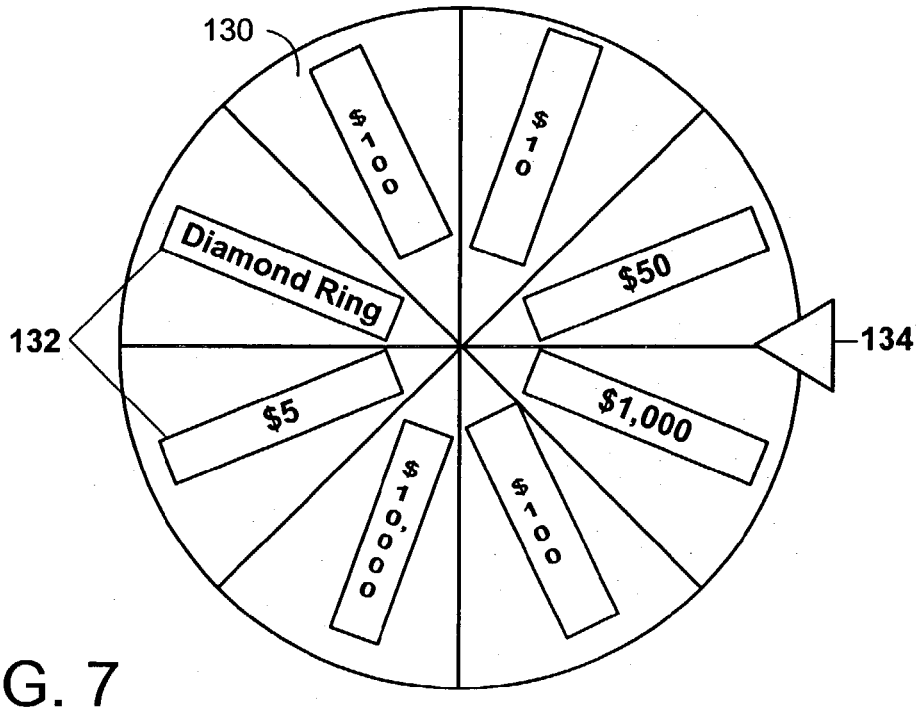
FIG. 7 illustrates an embodiment of a wheel having a plurality electronic displays.

FIG. 7 illustrates an embodiment of a wheel 130 that is divided into a plurality of sections and has a plurality of electronic displays 132 attached to each of sections of the wheel 130. The electronic displays 132 may be any displays well known to those skilled in the art, such as text-capable spectrum displays. The electronic displays 132 may be embedded within the wheel 130 and may further be operatively coupled to the controller 100 to control the symbols displayed and their appropriate orientation with respect to a player. The wheel 130 also has an award pointer 134 that may be used to indicate to the player the prize awarded based on the section of the wheel 130 that stops behind (or adjacent to) the award pointer 134. The wheel 130, the electronic displays 132, and the award pointer 134 may be enclosed within a housing, wherein the housing includes a plastic or glass display panel.

A sensor, such as an optical decoder, may be included and operatively coupled to the controller 100 to monitor the angular position of the wheel 130. The sensor may be used to determine what section of the wheel 130 stops behind the award pointer 134 when the wheel 130 stops rotating. The angular position of the wheel 130 may correspond to the section of the wheel that is adjacent the award pointer 134. As discussed with reference to FIGS. 4–6, the controller 100 may be programmed to adjust the orientation of the symbols displayed on the electronic displays 118 with a wide variety of frequencies, as well as updating the individual symbols to reflect current prizes. Additionally, the wheel 130, the electronic displays 132, and the award pointer 134 may be replaced by a video display unit that is operatively coupled to the controller 100 to generate video images of the components and update the orientation of the symbols on the wheel as the wheel rotates, so that the symbols remain logically legible to the player.

The controller 100 may also be programmed to determine a value payout associated with an outcome of a game incorporating the wheel 130. The outcome of the game may be determined by the section of the wheel 130 that stops next to the award pointer 134.

Figure 8:
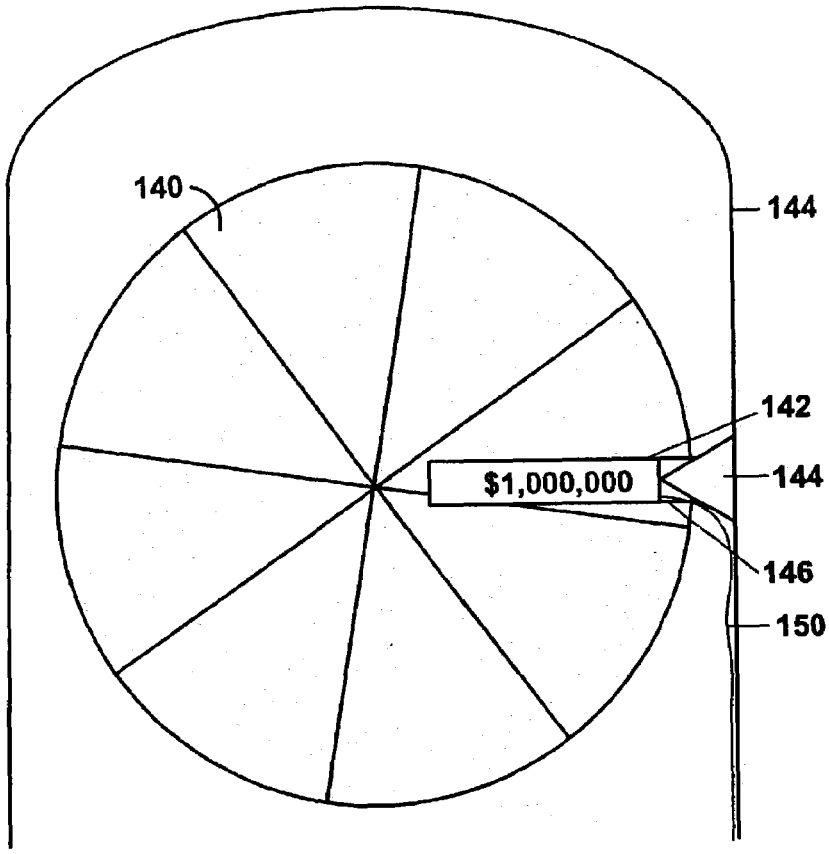
FIG. 8 illustrates a front view of an embodiment of a wheel having a floating electronic display.

FIG. 8 illustrates a front view of an embodiment of a mechanically rotatable wheel 140 that is divided into a plurality of sections and has a stationary electronic display 142 positioned adjacent to the wheel 130. The electronic display 142 is attached to a housing 144 by a support structure 146 and may be positioned to overlap, or float over, the wheel 140. The electronic display 142 may be any display well known to those skilled in the art, such as a text-capable spectrum display. The electronic display 142 may be operatively coupled to the controller 100 via a link 150 to control the symbols displayed on the electronic display 142. The wheel 140 may also have an award pointer 152 that may be used to indicate to the player the prize awarded based on the section of the wheel 140 that stops behind (or adjacent to) the award pointer 152. Alternatively, the award pointer 152 could rotate around the wheel 140, wherein the prize awarded to the player would be determined based on where the award pointer 152 stops in relation to the wheel 140. The prize indicated on the section of the wheel 140 that is located adjacent to the award pointer 152 may be displayed on the electronic display 142. The controller 100 could alternatively display on the electronic display 142 the prize that is indicated on the section of the wheel that is adjacent to (beneath in FIG. 8) the electronic display 142. It is also possible that multiple award pointers 152 could be used in conjunction with the wheel 140 and the electronic display 142.

A sensor, such as an optical decoder, and an optically coded segment 154 (FIG. 9) located on an axis 156 (FIG. 9) of the wheel 140 may be included. The sensor may be operatively coupled to the controller 100 to monitor the angular position of the wheel 140. The sensor may be used to determine what section of the wheel 140 that stops behind the award pointer 152 (or where the pointer 152 stops if it is moving). The angular position of the wheel 140 may correspond to the section of the wheel that is adjacent to the award pointer 152. As discussed with reference to FIGS. 4–7, the controller 100 may be programmed to update the symbols on the electronic display 142 to reflect current prizes, including current prize values.

The wheel 140 may have a section to award a variable jackpot, such as a progressive jackpot. The section may have the word "JACKPOT" displayed thereon, and the electronic display 142 could be dynamically updated to display the current value of the jackpot when the "JACKPOT" section is adjacent the award pointer 152. This could be true regardless of whether the wheel 140 is rotating and the award pointer 152 is stationary or whether the wheel 140 is stationary and the award pointer 152 is moving.

Figure 9:
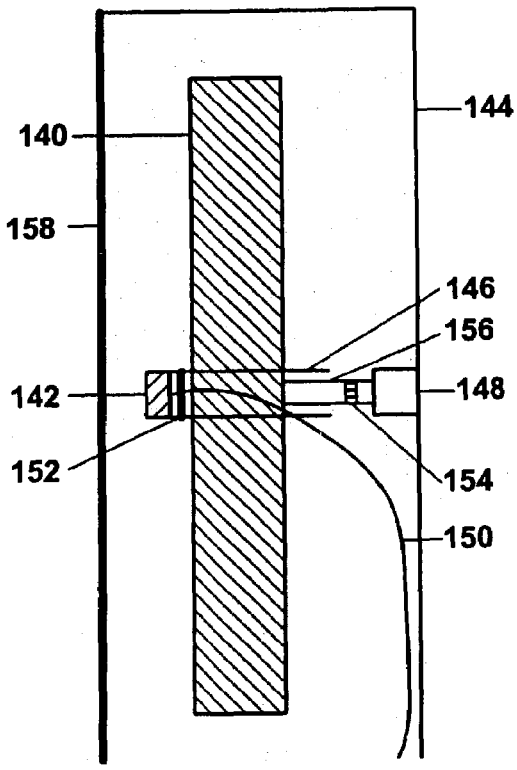
FIG. 9 illustrates a side view of the embodiment shown in FIG. 8.

FIG. 9 illustrates a side view of the embodiment shown in FIG. 8. In this view, a transparent display portion 158 attached to the housing 144 is visible. Also visible in this view are the axis 156, the optically coded segment 154 and the support structure 146 which were described with reference to FIG. 8.

It should be noted that the embodiments illustrated in FIGS. 4–9 may be part of a stand-alone primary game, or they may be added to other gaming units, such as gaming unit 20 from FIG. 2. If added to other gaming units, the games incorporating the wheels from FIGS. 4–9 may be part of a special bonus game accessible to players.

Figure 10:
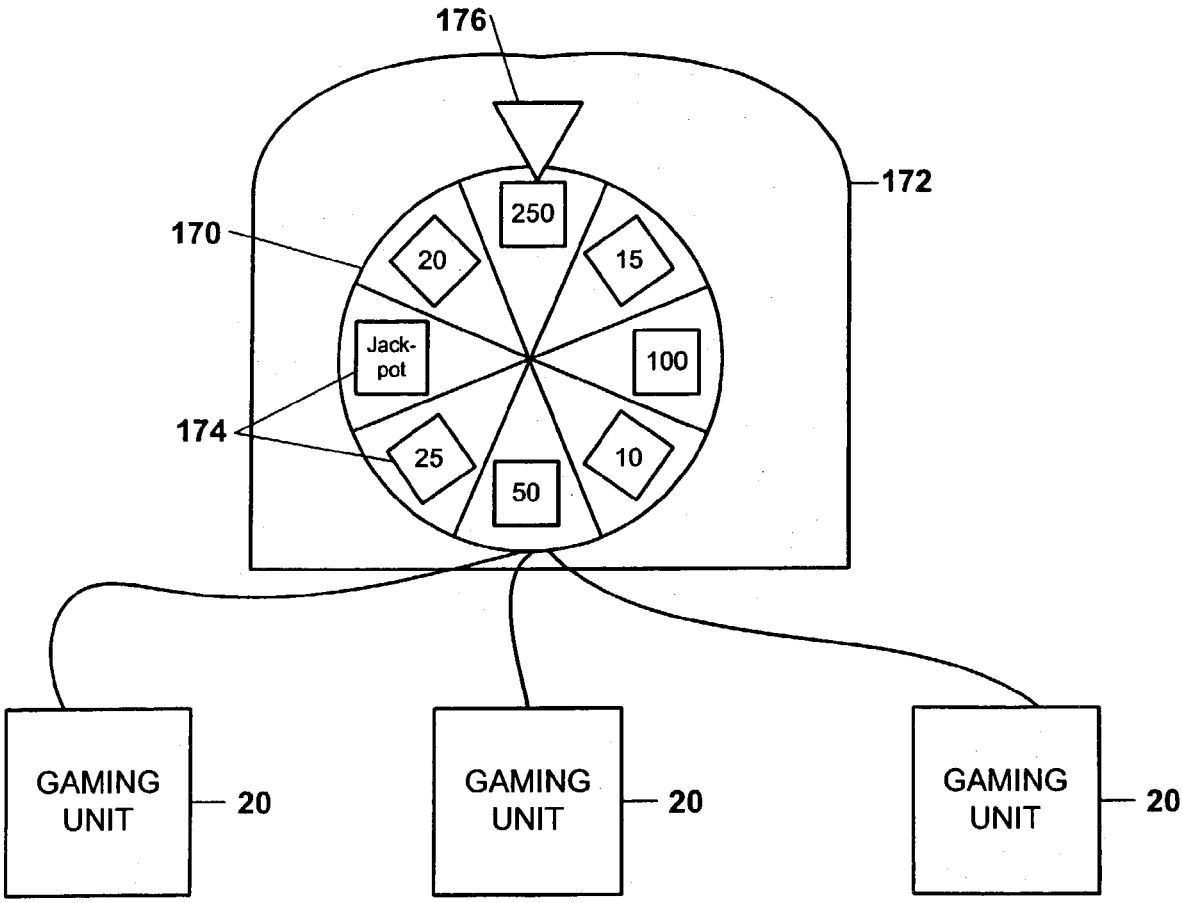
FIG. 10 illustrates an embodiment of a plurality of gaming apparatuses coupled to a remote wheel with a plurality of electronic displays.

FIG. 10 illustrates an embodiment of a wheel 170 attached to a housing 172, and operatively coupled to a plurality of gaming units 20. The wheel 170 may be used as part of a bonus game for the games played on the gaming units 20. The wheel 170 is divided into a plurality of slices and has a plurality of electronic displays 174 on each of the sections. The electronic displays 174 may be embedded within the wheel 170 and may further be operatively coupled to the controller 100 to control the symbols displayed and their appropriate orientation with respect to a player. The wheel 170 may also have an award pointer 176 that may be used to indicate to the player the prize awarded based on the section of the wheel that stops behind (or adjacent to) the award pointer 176 (or the section that the award pointer 176 stops at if it is moving and the wheel is stationary).

A sensor, such as an optical decoder, may be included and operatively coupled to the controller 100 to monitor the angular position of the wheel 170. The sensor may be used to determine what section of the wheel 170 that stops behind the award pointer 176 when the wheel 170 stops rotating. The angular position of the wheel 170 may correspond to the section of the wheel that is adjacent to award pointer 176. As discussed with reference to FIGS. 4–7, the controller 100 may be programmed to adjust the orientation of the symbols displayed on the electronic displays 174 with a wide variety of frequencies as well as updating the individual symbols to reflect current prizes.

The wheel 170 may have a section to award a variable jackpot, such as a progressive jackpot. This jackpot could be contributed to and won by any of the players playing the gaming units 20. The section may have the word "JACKPOT" displayed thereon, and the electronic display 174 could be dynamically updated to display the current value of the jackpot when the "JACKPOT" section is adjacent the award pointer 176. It should also be noted that the wheel 170, the electronic displays 174, and the award pointer 134 may be replaced by a video display unit that is operatively coupled to the controller 100 to generate video images of the components and update the orientation of the symbols on the wheel as the wheel rotates, so that the symbols remain logically legible to the player. Furthermore, the video image of the wheel may be an image of a two-dimensional wheel or a three-dimensional wheel.

Overall Operation of Gaming Unit

One manner in which one or more of the gaming units 20 (and one or more of the gaming units 30) may operate is described below in connection with a number of flowcharts which represent a number of portions or routines of one or more computer programs, which may be stored in one or more of the memories of the controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C++, C#, Java or the like or any low-level assembly or machine language. By storing the computer program portions therein, various portions of the memories 102, 106 are physically and/or structurally configured in accordance with computer program instructions.

Figure 11:
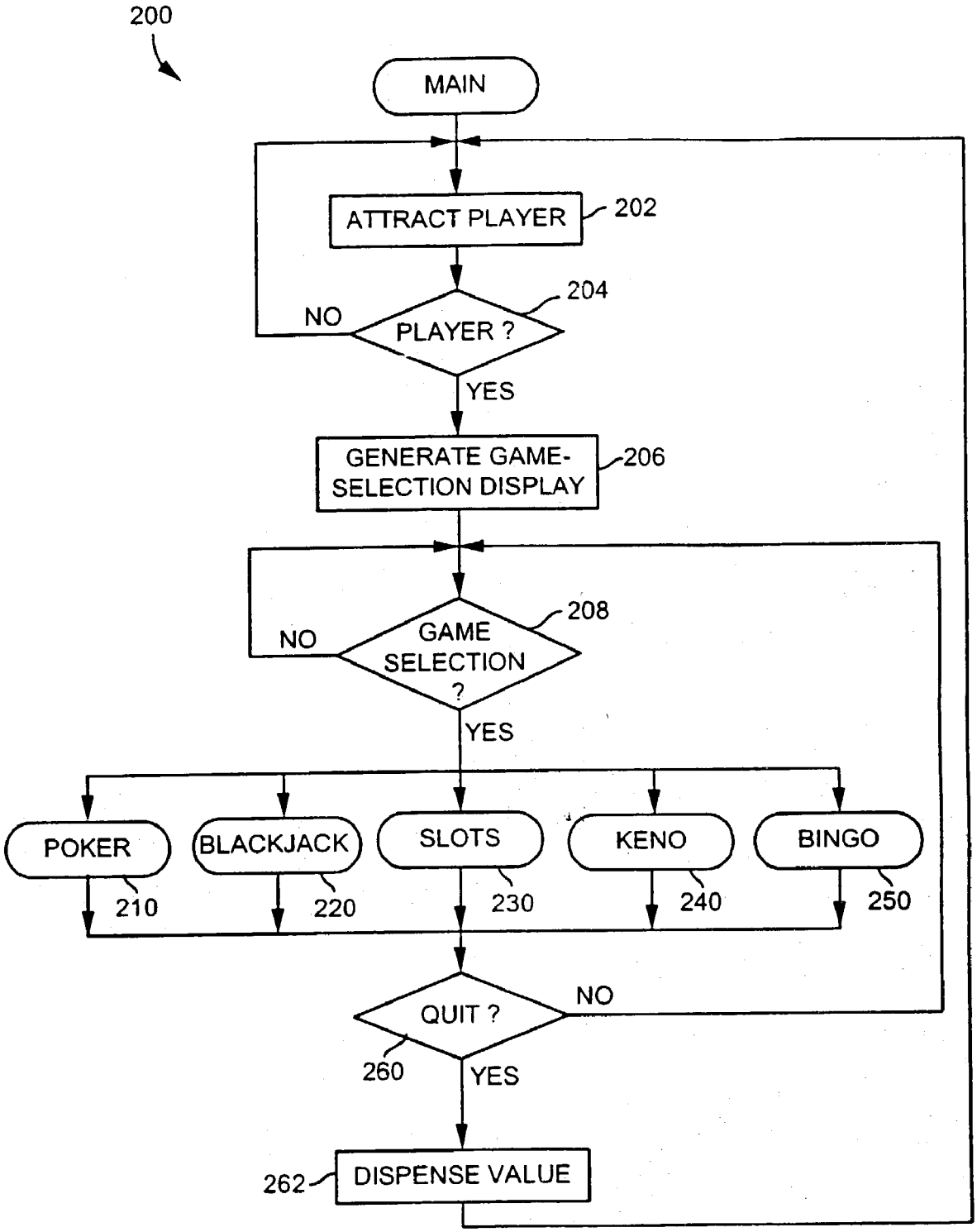
FIG. 11 is a flowchart of an embodiment of a main routine that may be performed during operation of one or more of the gaming units.

FIG. 11 is a flowchart of a main operating routine 200 that may be stored in the memory of the controller 100. Referring to FIG. 11, the main routine 200 may begin operation at block 202 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62. The attraction sequence may include a scrolling list of games that may be played on the gaming unit 20 and/or video images of various games being played, such as video poker, video blackjack, video slots, video keno, video bingo, video pachinko, etc.

During performance of the attraction sequence, if a potential player makes any input to the gaming unit 20 as determined at block 204, the attraction sequence may be terminated and a game-selection display may be generated on the display unit 70 at block 206 to allow the player to select a game available on the gaming unit 20. The gaming unit 20 may detect an input at block 204 in various ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit; etc.

The game-selection display generated at block 206 may include, for example, a list of video games that may be played on the gaming unit 20 and/or a visual message to prompt the player to deposit value into the gaming unit 20. While the game-selection display is generated, the gaming unit 20 may wait for the player to make a game selection. Upon selection of one of the games by the player as determined at block 208, the controller 100 may cause one of a number of game routines to be performed to allow the selected game to be played. For example, the game routines could include a video poker routine 210, a video blackjack routine 220, a slots routine 230, a video keno routine 240, and a video bingo routine 250. At block 208, if no game selection is made within a given period of time, the operation may branch back to block 202.

After one of the routines 210, 220, 230, 240, 250 has been performed to allow the player to play one of the games, block 260 may be utilized to determine whether the player wishes to terminate play on the gaming unit 20 or to select another game. If the player wishes to stop playing the gaming unit 20, which wish may be expressed, for example, by selecting a "Cash Out" button, the controller 100 may dispense value to the player at block 262 based on the outcome of the game(s) played by the player. The operation may then return to block 202. If the player did not wish to quit as determined at block 260, the routine may return to block 208 where the game-selection display may again be generated to allow the player to select another game.

It should be noted that although five gaming routines are shown in FIG. 11, a different number of routines could be included to allow play of a different number of games. The gaming unit 20 may also be programmed to allow play of different games.

Figure 12:
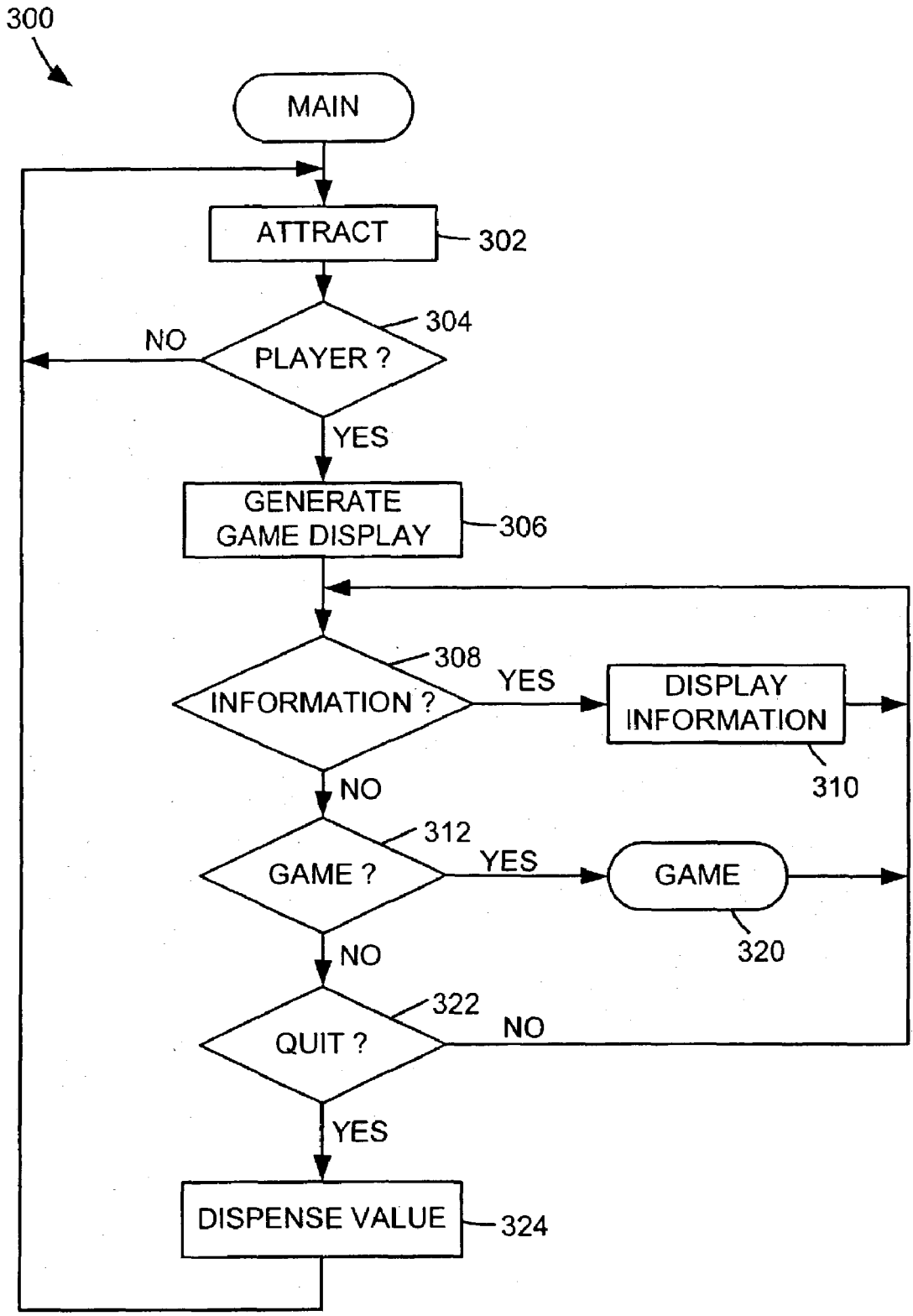
FIG. 12 is a flowchart of an alternative embodiment of a main routine that may be performed during operation of one or more of the gaming units.

FIG. 12 is a flowchart of an alternative main operating routine 300 that may be stored in the memory of the controller 100. The main routine 300 may be utilized for gaming units 20 that are designed to allow play of only a single game or single type of game. Referring to FIG. 12, the main routine 300 may begin operation at block 302 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62.

During performance of the attraction sequence, if a potential player makes any input to the gaming unit 20 as determined at block 304, the attraction sequence may be terminated and a game display may be generated on the display unit 70 at block 306. The game display generated at block 306 may include, for example, an image of the casino game that may be played on the gaming unit 20 and/or a visual message to prompt the player to deposit value into the gaming unit 20. At block 308, the gaming unit 20 may determine if the player requested information concerning the game, in which case the requested information may be displayed at block 310. Block 312 may be used to determine if the player requested initiation of a game, in which case a game routine 320 may be performed. The game routine 320 could be any one of the game routines disclosed herein, such as one of the five game routines 210, 220, 230, 240, 250, or another game routine.

After the routine 320 has been performed to allow the player to play the game, block 322 may be utilized to determine whether the player wishes to terminate play on the gaming unit 20. If the player wishes to stop playing the gaming unit 20, which wish may be expressed, for example, by selecting a "Cash Out" button, the controller 100 may dispense value to the player at block 324 based on the outcome of the game(s) played by the player. The operation may then return to block 302. If the player did not wish to quit as determined at block 322, the operation may return to block 308.

Video Poker

Figure 13:
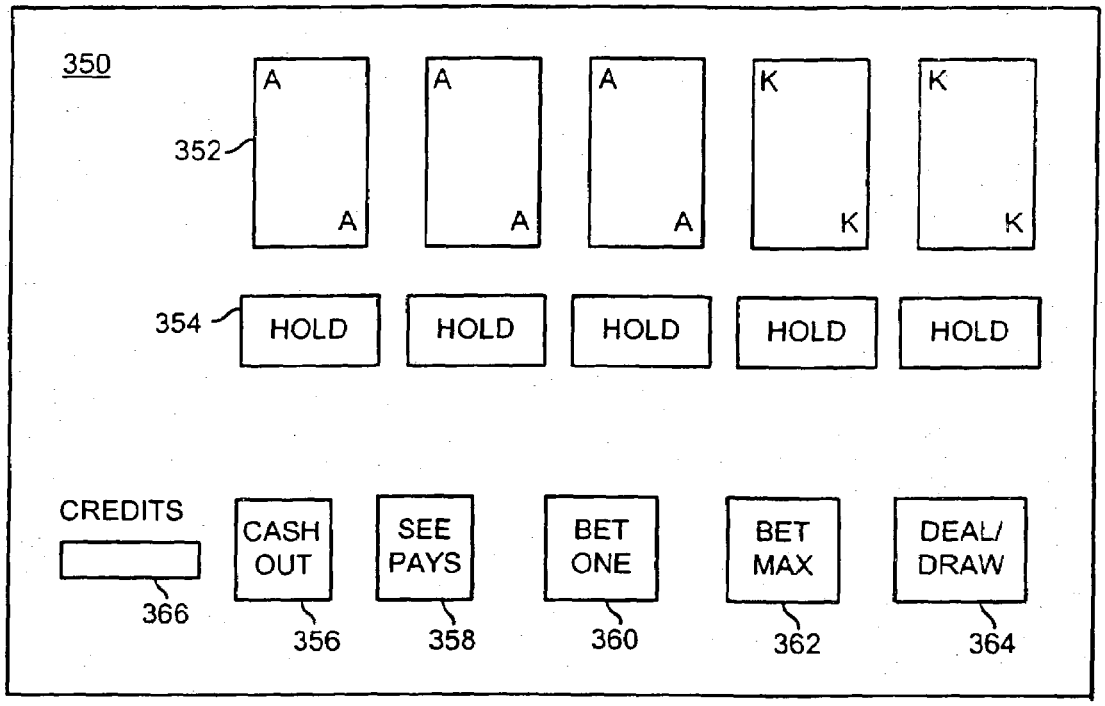
FIG. 13 is an illustration of an embodiment of a visual display that may be displayed during performance of the video poker routine of FIG. 8.

FIG. 13 is an exemplary display 350 that may be shown on the display unit 70 during performance of the video poker routine 210 shown schematically in FIG. 11. Referring to FIG. 13, the display 350 may include video images 352 of a plurality of playing cards representing the player's hand, such as five cards. To allow the player to control the play of the video poker game, a plurality of player-selectable buttons may be displayed. The buttons may include a "Hold" button 354 disposed directly below each of the playing card images 352, a "Cash Out" button 356, a "See Pays" button 358, a "Bet One Credit" button 360, a "Bet Max Credits" button 362, and a "Deal/Draw" button 364. The display 350 may also include an area 366 in which the number of remaining credits or value is displayed. If the display unit 70 is provided with a touch-sensitive screen, the buttons 354, 356, 358, 360, 362, 364 may form part of the video display 350. Alternatively, one or more of those buttons may be provided as part of a control panel that is provided separately from the display unit 70.

Figure 15:
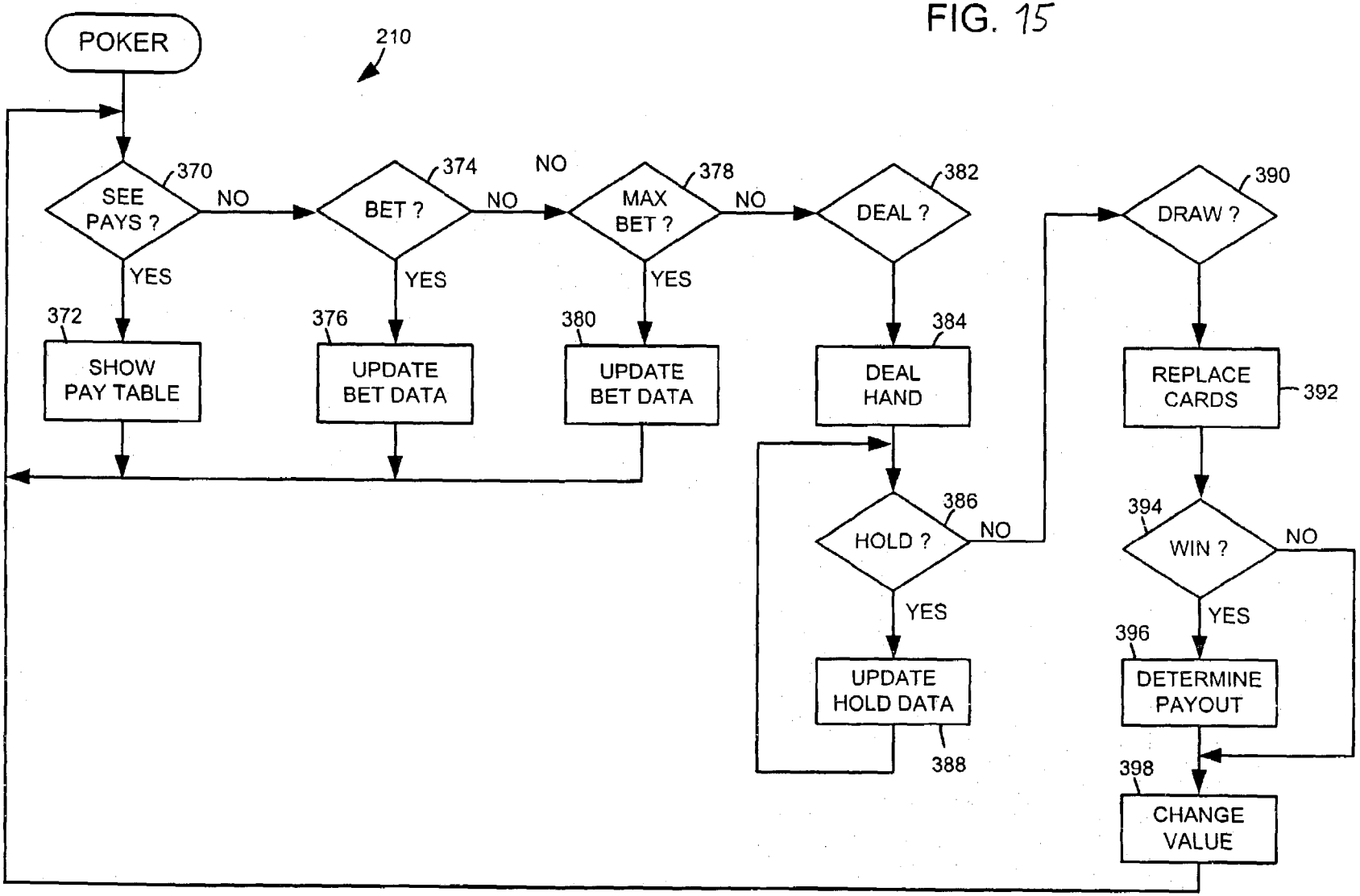
FIG. 15 is a flowchart of an embodiment of a video poker routine that may be performed by one or more of the gaming units.

FIG. 15 is a flowchart of the video poker routine 210 shown schematically in FIG. 11. Referring to FIG. 15, at block 370, the routine may determine whether the player has requested payout information, such as by activating the "See Pays" button 358, in which case at block 372 the routine may cause one or more pay tables to be displayed on the display unit 70. At block 374, the routine may determine whether the player has made a bet, such as by pressing the "Bet One Credit" button 360, in which case at block 376 bet data corresponding to the bet made by the player may be stored in the memory of the controller 100. At block 378, the routine may determine whether the player has pressed the "Bet Max Credits" button 362, in which case at block 380 bet data corresponding to the maximum allowable bet may be stored in the memory of the controller 100.

At block 382, the routine may determine if the player desires a new hand to be dealt, which may be determined by detecting if the "Deal/Draw" button 364 was activated after a wager was made. In that case, at block 384 a video poker hand may be "dealt" by causing the display unit 70 to generate the playing card images 352. After the hand is dealt, at block 386 the routine may determine if any of the "Hold" buttons 354 have been activated by the player, in which case data regarding which of the playing card images 352 are to be "held" may be stored in the controller 100 at block 388. If the "Deal/Draw" button 364 is activated again as determined at block 390, each of the playing card images 352 that was not "held" may be caused to disappear from the video display 350 and to be replaced by a new, randomly selected, playing card image 352 at block 392.

At block 394, the routine may determine whether the poker hand represented by the playing card images 352 currently displayed is a winner. That determination may be made by comparing data representing the currently displayed poker hand with data representing all possible winning hands, which may be stored in the memory of the controller 100. If there is a winning hand, a payout value corresponding to the winning hand may be determined at block 396. At block 398, the player's cumulative value or number of credits may be updated by subtracting the bet made by the player and adding, if the hand was a winner, the payout value determined at block 396. The cumulative value or number of credits may also be displayed in the display area 366 (FIG. 13).

Although the video poker routine 210 is described above in connection with a single poker hand of five cards, the routine 210 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Video Blackjack

Figure 14:
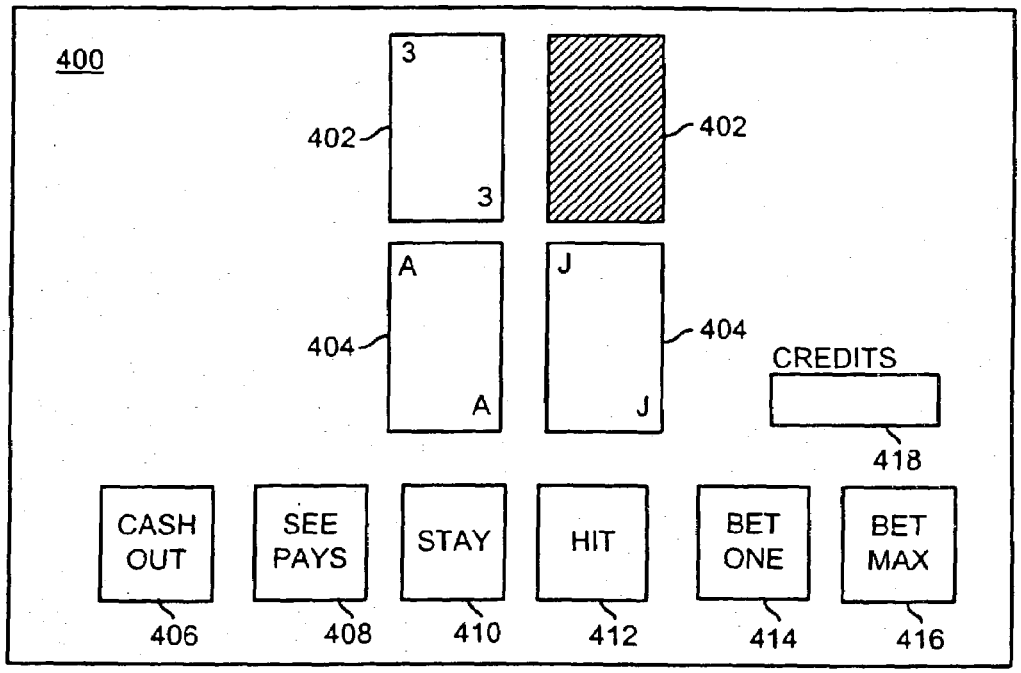
FIG. 14 is an illustration of an embodiment of a visual display that may be displayed during performance of the video blackjack routine of FIG. 9.

FIG. 13 is an exemplary display 400 that may be shown on the display unit 70 during performance of the video blackjack routine 220 shown schematically in FIG. 11. Referring to FIG. 14, the display 400 may include video images 402 of a pair of playing cards representing a dealer's hand, with one of the cards shown face up and the other card being shown face down, and video images 404 of a pair of playing cards representing a player's hand, with both the cards shown face up. The "dealer" may be the gaming unit 20.

To allow the player to control the play of the video blackjack game, a plurality of player-selectable buttons may be displayed. The buttons may include a "Cash Out" button 406, a "See Pays" button 408, a "Stay" button 410, a "Hit" button 412, a "Bet One Credit" button 414, and a "Bet Max Credits" button 416. The display 400 may also include an area 418 in which the number of remaining credits or value is displayed. If the display unit 70 is provided with a touch-sensitive screen, the buttons 406, 408, 410, 412, 414, 416 may form part of the video display 400. Alternatively, one or more of those buttons may be provided as part of a control panel that is provided separately from the display unit 70.

Figure 16:
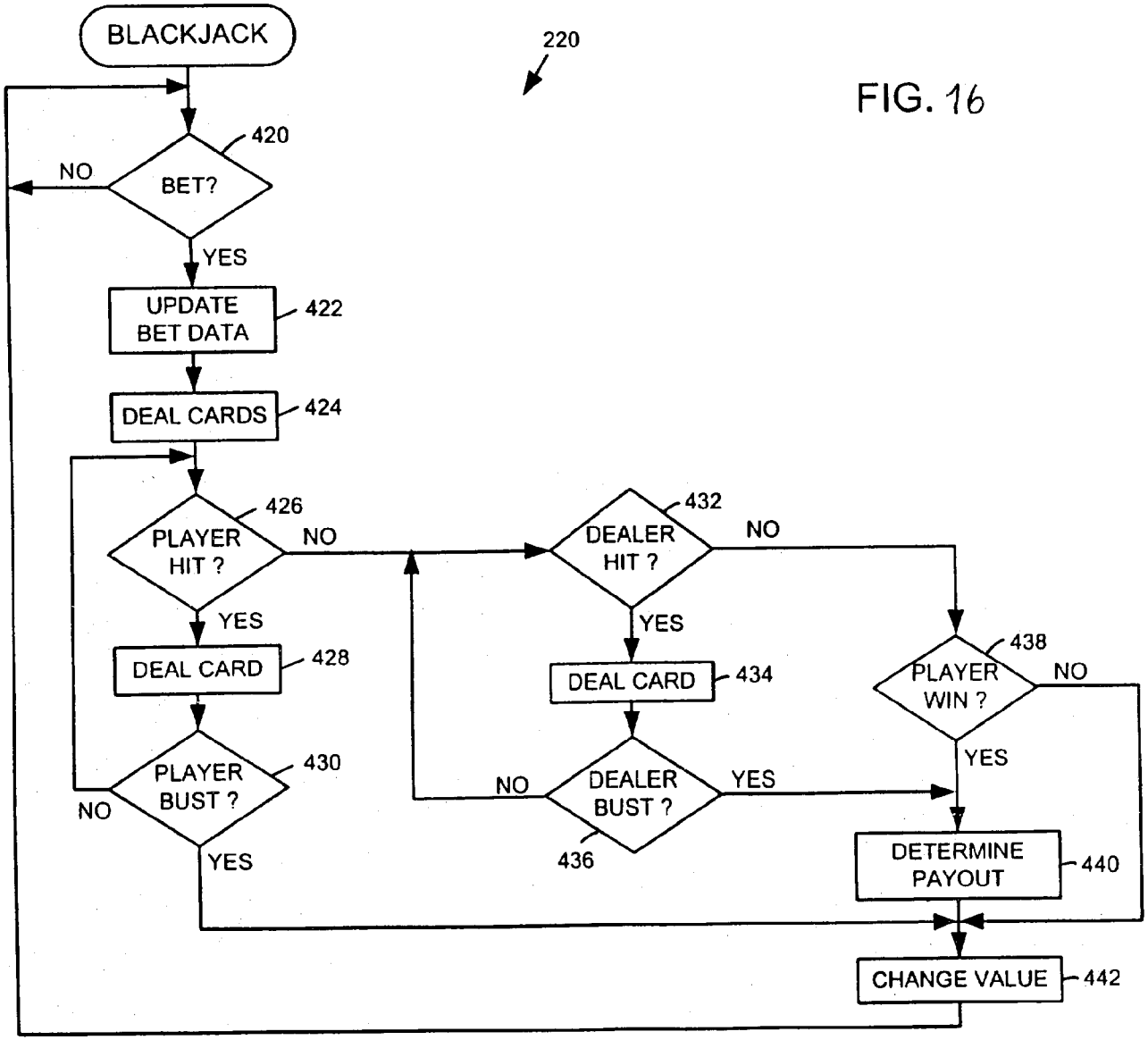
FIG. 16 is a flowchart of an embodiment of a video blackjack routine that may be performed by one or more of the gaming units.

FIG. 16 is a flowchart of the video blackjack routine 220 shown schematically in FIG. 11. Referring to FIG. 16, the video blackjack routine 220 may begin at block 420 where it may determine whether a bet has been made by the player. That may be determined, for example, by detecting the activation of either the "Bet One Credit" button 414 or the "Bet Max Credits" button 416. At block 422, bet data corresponding to the bet made at block 420 may be stored in the memory of the controller 100. At block 424, a dealer's hand and a player's hand may be "dealt" by making the playing card images 402, 404 appear on the display unit 70.

At block 426, the player may be allowed to be "hit," in which case at block 428 another card will be dealt to the player's hand by making another playing card image 404 appear in the display 400. If the player is hit, block 430 may determine if the player has "bust," or exceeded 21. If the player has not bust, blocks 426 and 428 may be performed again to allow the player to be hit again.

If the player decides not to hit, at block 432 the routine may determine whether the dealer should be hit. Whether the dealer hits may be determined in accordance with predetermined rules, such as the dealer always hit if the dealer's hand totals 15 or less. If the dealer hits, at block 434 the dealer's hand may be dealt another card by making another playing card image 402 appear in the display 400. At block 436 the routine may determine whether the dealer has bust. If the dealer has not bust, blocks 432, 434 may be performed again to allow the dealer to be hit again.

If the dealer does not hit, at block 436 the outcome of the blackjack game and a corresponding payout may be determined based on, for example, whether the player or the dealer has the higher hand that does not exceed 21. If the player has a winning hand, a payout value corresponding to the winning hand may be determined at block 440. At block 442, the player's cumulative value or number of credits may be updated by subtracting the bet made by the player and adding, if the player won, the payout value determined at block 440. The cumulative value or number of credits may also be displayed in the display area 418 (FIG. 14).

Slots

FIG. 17 is an exemplary display 450 that may be shown on the display unit 70 during performance of the slots routine 230 shown schematically in FIG. 11. Referring to FIG. 17, the display 450 may include video images 452 of a plurality of slot machine reels, each of the reels having a plurality of reel symbols 454 associated therewith. Although the display 450 shows five reel images 452, each of which may have three reel symbols 454 that are visible at a time, other reel configurations could be utilized.

To allow the player to control the play of the slots game, a plurality of player-selectable buttons may be displayed. The buttons may include a "Cash Out" button 456, a "See Pays" button 458, a plurality of payline-selection buttons 460 each of which allows the player to select a different number of paylines prior to "spinning" the reels, a plurality of bet-selection buttons 462 each of which allows a player to specify a wager amount for each payline selected, a "Spin" button 464, and a "Max Bet" button 466 to allow a player to make the maximum wager allowable.

Figure 19:
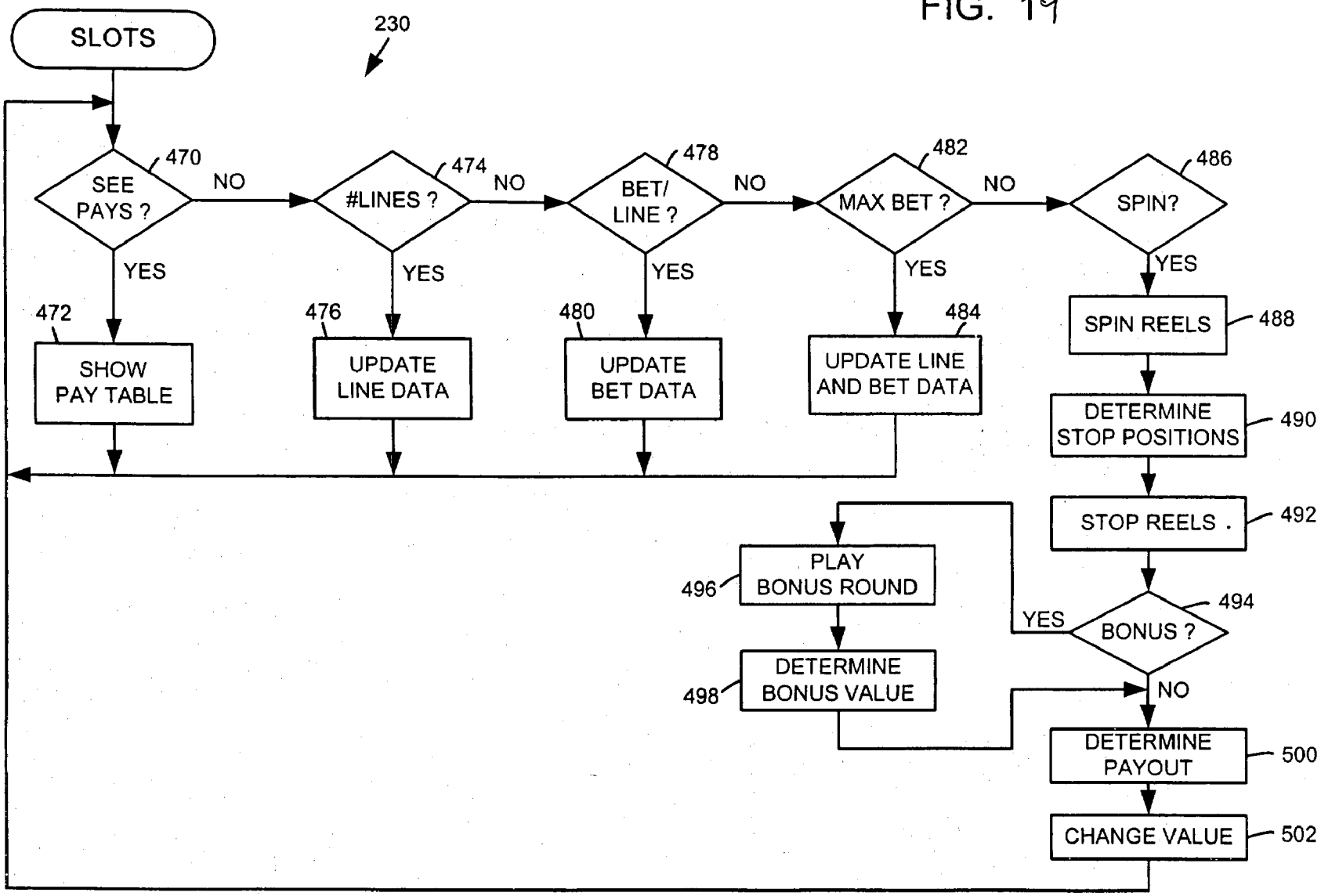
FIG. 19 is a flowchart of an embodiment of a slots routine that may be performed by one or more of the gaming units.

FIG. 19 is a flowchart of the slots routine 230 shown schematically in FIG. 17. Referring to FIG. 19, at block 470, the routine may determine whether the player has requested payout information, such as by activating the "See Pays" button 458, in which case at block 472 the routine may cause one or more pay tables to be displayed on the display unit 70. At block 474, the routine may determine whether the player has pressed one of the payline-selection buttons 460, in which case at block 476 data corresponding to the number of paylines selected by the player may be stored in the memory of the controller 100. At block 478, the routine may determine whether the player has pressed one of the bet-selection buttons 462, in which case at block 480 data corresponding to the amount bet per payline may be stored in the memory of the controller 100. At block 482, the routine may determine whether the player has pressed the "Max Bet" button 466, in which case at block 484 bet data (which may include both payline data and bet-per-payline data) corresponding to the maximum allowable bet may be stored in the memory of the controller 100.

If the "Spin" button 464 has been activated by the player as determined at block 486, at block 488 the routine may cause the slot machine reel images 452 to begin "spinning" so as to simulate the appearance of a plurality of spinning mechanical slot machine reels. At block 490, the routine may determine the positions at which the slot machine reel images will stop, or the particular symbol images 454 that will be displayed when the reel images 452 stop spinning. At block 492, the routine may stop the reel images 452 from spinning by displaying stationary reel images 452 and images of three symbols 454 for each stopped reel image 452. The virtual reels may be stopped from left to right, from the perspective of the player, or in any other manner or sequence.

The routine may provide for the possibility of a bonus game or round if certain conditions are met, such as the display in the stopped reel images 452 of a particular symbol 454. If there is such a bonus condition as determined at block 494, the routine may proceed to block 496 where a bonus round may be played. The bonus round may be a different game than slots, and many other types of bonus games could be provided. If the player wins the bonus round, or receives additional credits or points in the bonus round, a bonus value may be determined at block 498. A payout value corresponding to outcome of the slots game and/or the bonus round may be determined at block 500. At block 502, the player's cumulative value or number of credits may be updated by subtracting the bet made by the player and adding, if the slot game and/or bonus round was a winner, the payout value determined at block 500.

Although the above routine has been described as a virtual slot machine routine in which slot machine reels are represented as images on the display unit 70, actual slot machine reels that are capable of being spun may be utilized instead.

Video Keno

FIG. 18 is an exemplary display 520 that may be shown on the display unit 70 during performance of the video keno routine 240 shown schematically in FIG. 11. Referring to FIG. 18, the display 520 may include a video image 522 of a plurality of numbers that were selected by the player prior to the start of a keno game and a video image 524 of a plurality of numbers randomly selected during the keno game. The randomly selected numbers may be displayed in a grid pattern.

To allow the player to control the play of the keno game, a plurality of player-selectable buttons may be displayed. The buttons may include a "Cash Out" button 526, a "See Pays" button 528, a "Bet One Credit" button 530, a "Bet Max Credits" button 532, a "Select Ticket" button 534, a "Select Number" button 536, and a "Play" button 538. The display 520 may also include an area 540 in which the number of remaining credits or value is displayed. If the display unit 70 is provided with a touch-sensitive screen, the buttons may form part of the video display 520. Alternatively, one or more of those buttons may be provided as part of a control panel that is provided separately from the display unit 70.

Figure 20:
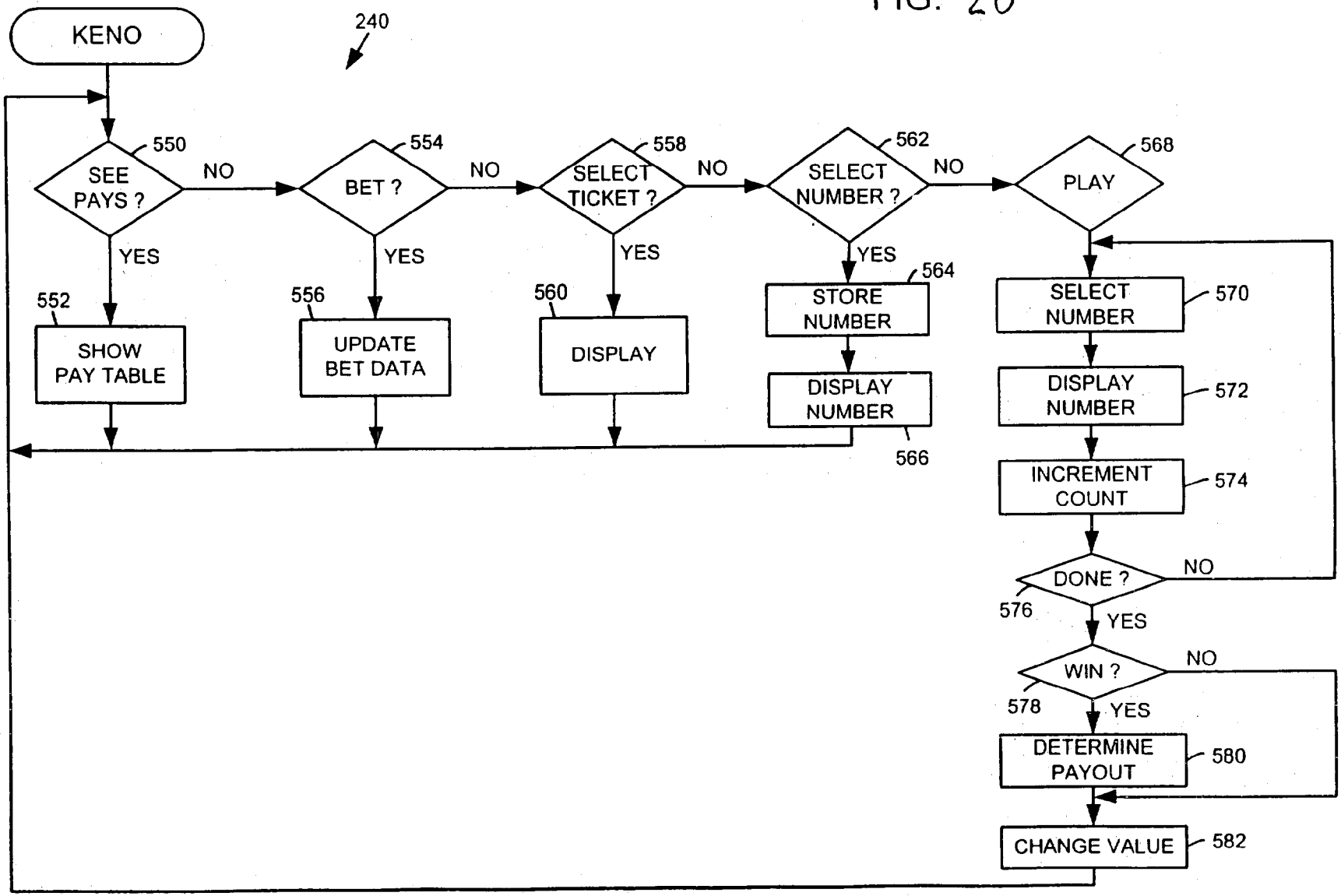
FIG. 20 is a flowchart of an embodiment of a video keno routine that may be performed by one or more of the gaming units.

FIG. 20 is a flowchart of the video keno routine 240 shown schematically in FIG. 11. The keno routine 240 may be utilized in connection with a single gaming unit 20 where a single player is playing a keno game, or the keno routine 240 may be utilized in connection with multiple gaming units 20 where multiple players are playing a single keno game. In the latter case, one or more of the acts described below may be performed either by the controller 100 in each gaming unit or by one of the network computer 22, 32 to which multiple gaming units 20 are operatively connected.

Referring to FIG. 20, at block 550, the routine may determine whether the player has requested payout information, such as by activating the "See Pays" button 528, in which case at block 552 the routine may cause one or more pay tables to be displayed on the display unit 70. At block 554, the routine may determine whether the player has made a bet, such as by having pressed the "Bet One Credit" button 530 or the "Bet Max Credits" button 532, in which case at block 556 bet data corresponding to the bet made by the player may be stored in the memory of the controller 100. After the player has made a wager, at block 558 the player may select a keno ticket, and at block 560 the ticket may be displayed on the display 520. At block 562, the player may select one or more game numbers, which may be within a range set by the casino. After being selected, the player's game numbers may be stored in the memory of the controller 100 at block 564 and may be included in the image 522 on the display 520 at block 566. After a certain amount of time, the keno game may be closed to additional players (where a number of players are playing a single keno game using multiple gambling units 20).

If play of the keno game is to begin as determined at block 568, at block 570 a game number within a range set by the casino may be randomly selected either by the controller 100 or a central computer operatively connected to the controller, such as one of the network computers 22, 32. At block 572, the randomly selected game number may be displayed on the display unit 70 and the display units 70 of other gaming units 20 (if any) which are involved in the same keno game. At block 574, the controller 100 (or the central computer noted above) may increment a count which keeps track of how many game numbers have been selected at block 570.

At block 576, the controller 100 (or one of the network computers 22, 32) may determine whether a maximum number of game numbers within the range have been randomly selected. If not, another game number may be randomly selected at block 570. If the maximum number of game numbers has been selected, at block 578 the controller 100 (or a central computer) may determine whether there are a sufficient number of matches between the game numbers selected by the player and the game numbers selected at block 570 to cause the player to win. The number of matches may depend on how many numbers the player selected and the particular keno rules being used.

If there are a sufficient number of matches, a payout may be determined at block 580 to compensate the player for winning the game. The payout may depend on the number of matches between the game numbers selected by the player and the game numbers randomly selected at block 570. At block 582, the player's cumulative value or number of credits may be updated by subtracting the bet made by the player and adding, if the keno game was won, the payout value determined at block 580. The cumulative value or number of credits may also be displayed in the display area 540 (FIG. 18).

Video Bingo

Figure 21:
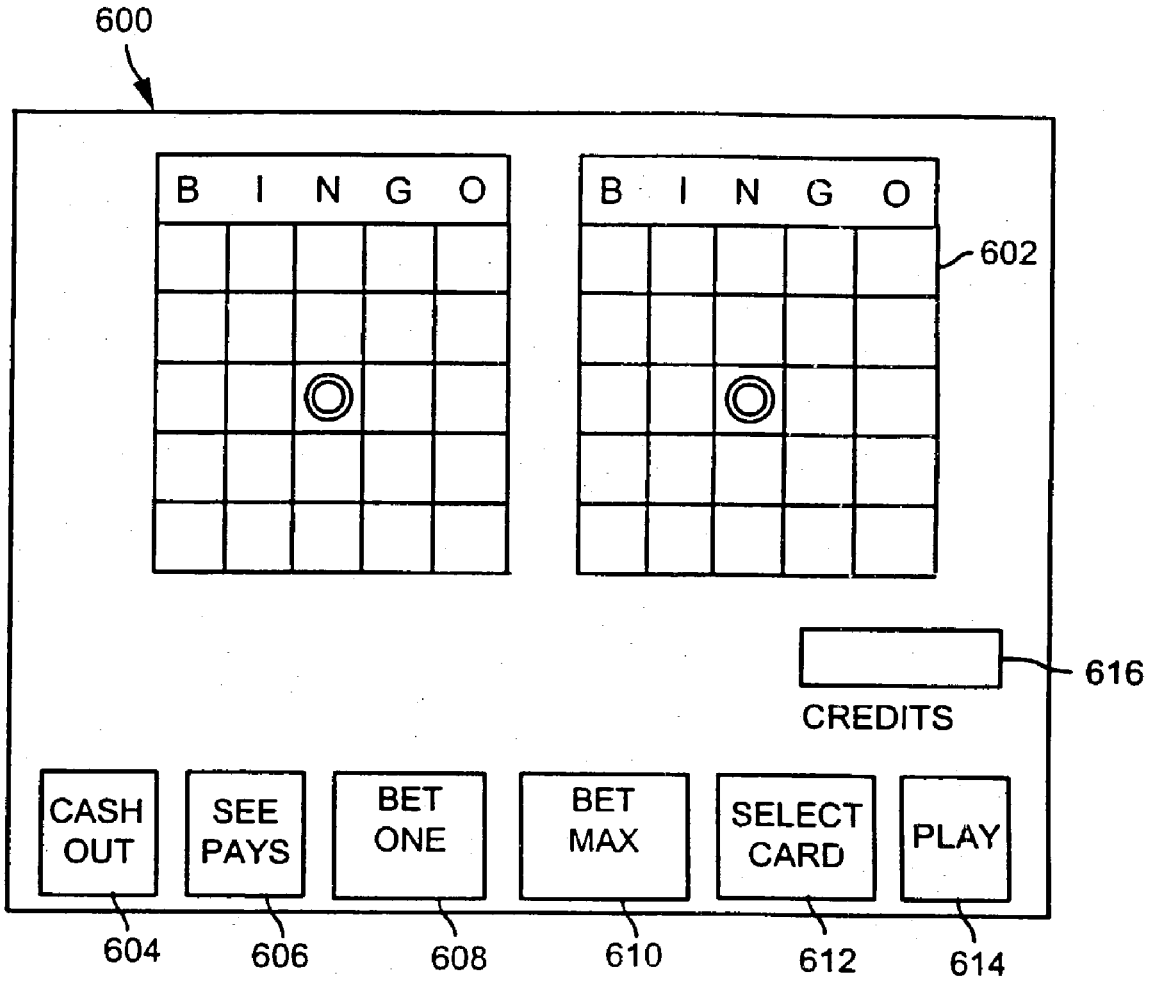
FIG. 21 is an illustration of an embodiment of a visual display that may be displayed during performance of the video bingo routine of FIG. 15.

FIG. 21 is an exemplary display 600 that may be shown on the display unit 70 during performance of the video bingo routine 250 shown schematically in FIG. 11. Referring to FIG. 21, the display 600 may include one or more video images 602 of a bingo card and images of the bingo numbers selected during the game. The bingo card images 602 may have a grid pattern.

To allow the player to control the play of the bingo game, a plurality of player-selectable buttons may be displayed. The buttons may include a "Cash Out" button 604, a "See Pays" button 606, a "Bet One Credit" button 608, a "Bet Max Credits" button 610, a "Select Card" button 612, and a "Play" button 614. The display 600 may also include an area 616 in which the number of remaining credits or value is displayed. If the display unit 70 is provided with a touch-sensitive screen, the buttons may form part of the video display 600. Alternatively, one or more of those buttons may be provided as part of a control panel that is provided separately from the display unit 70.

Figure 22:
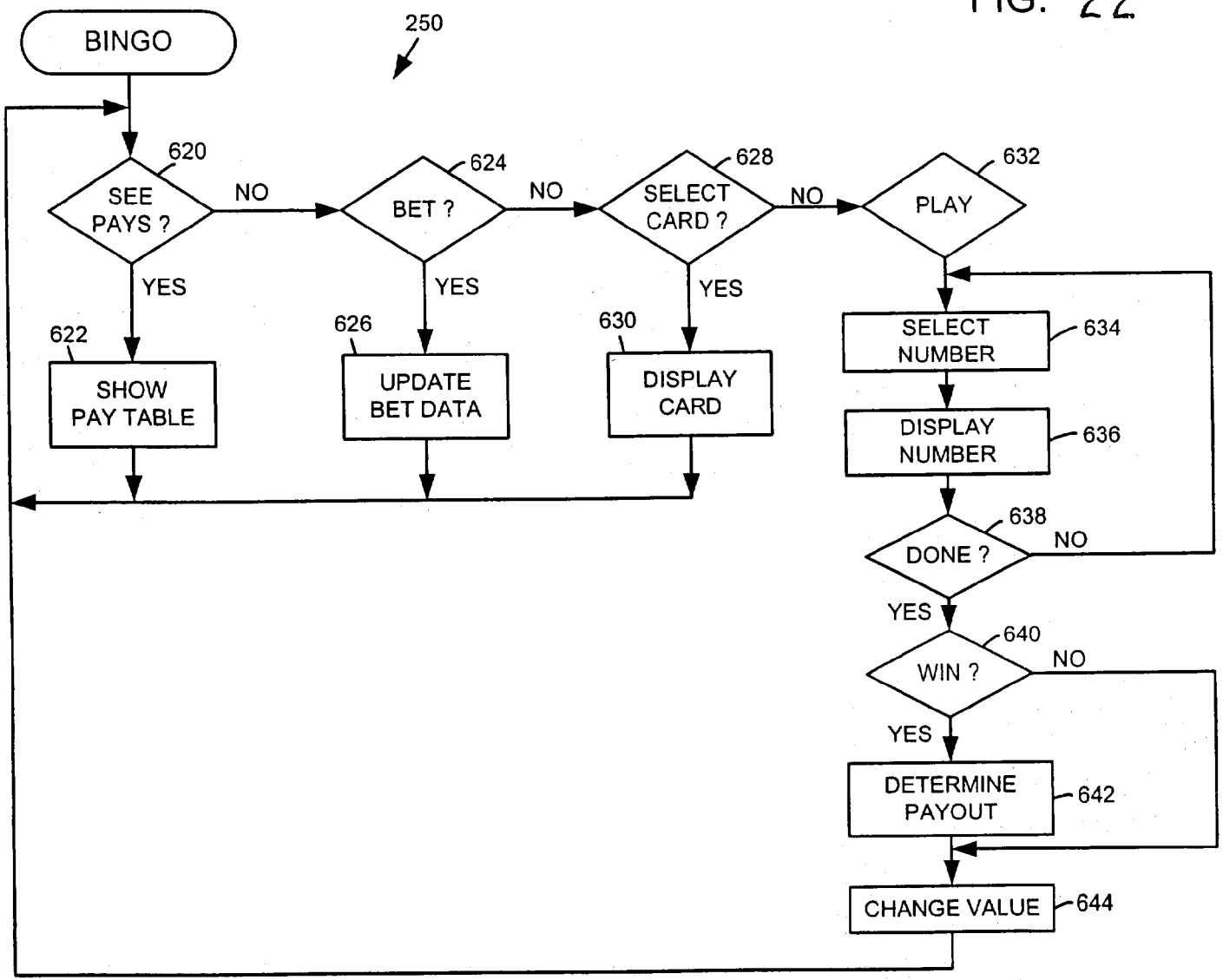
FIG. 22 is a flowchart of an embodiment of a video bingo routine that may be performed by one or more of the gaming units.

FIG. 22 is a flowchart of the video bingo routine 250 shown schematically in FIG. 11. The bingo routine 250 may be utilized in connection with a single gaming unit 20 where a single player is playing a bingo game, or the bingo routine 250 may be utilized in connection with multiple gaming units 20 where multiple players are playing a single bingo game. In the latter case, one or more of the acts described below may be performed either by the controller 100 in each gaming unit 20 or by one of the network computers 22, 32 to which multiple gaming units 20 are operatively connected.

Referring to FIG. 22, at block 620, the routine may determine whether the player has requested payout information, such as by activating the "See Pays" button 606, in which case at block 622 the routine may cause one or more pay tables to be displayed on the display unit 70. At block 624, the routine may determine whether the player has made a bet, such as by having pressed the "Bet One Credit" button 608 or the "Bet Max Credits" button 610, in which case at block 626 bet data corresponding to the bet made by the player may be stored in the memory of the controller 100.

After the player has made a wager, at block 628 the player may select a bingo card, which may be generated randomly. The player may select more than one bingo card, and there may be a maximum number of bingo cards that a player may select. After play is to commence as determined at block 632, at block 634 a bingo number may be randomly generated by the controller 100 or a central computer such as one of the network computers 22, 32. At block 636, the bingo number may be displayed on the display unit 70 and the display units 70 of any other gaming units 20 involved in the bingo game.

At block 638, the controller 100 (or a central computer) may determine whether any player has won the bingo game. If no player has won, another bingo number may be randomly selected at block 634. If any player has bingo as determined at block 638, the routine may determine at block 640 whether the player playing that gaming unit 20 was the winner. If so, at block 642 a payout for the player may be determined. The payout may depend on the number of random numbers that were drawn before there was a winner, the total number of winners (if there was more than one player), and the amount of money that was wagered on the game. At block 644, the player's cumulative value or number of credits may be updated by subtracting the bet made by the player and adding, if the bingo game was won, the payout value determined at block 642. The cumulative value or number of credits may also be displayed in the display area 616 (FIG. 21).

What is claimed is:

1. A gaming apparatus, comprising:

a display unit that is capable of generating video images;

a value input device;

a controller operatively coupled to said display unit and said value input device, said controller comprising a processor and a memory operatively coupled to said processor, said controller being programmed to allow a person to make a wager, said controller being programmed to cause a first display portion representing a game to be generated on said display unit, said first display portion representing one of the following games: video poker, video blackjack, video slots, video keno or video bingo, said first display portion comprising an image of at least five playing cards if said game comprises video poker, said first display portion comprising an image of a plurality of simulated slot machine reels if said game comprises video slots, said first display portion comprising an image of a plurality of playing cards if said game comprises video blackjack, said first display portion comprising an image of a plurality of keno numbers if said game comprises video keno, said first display portion comprising an image of a bingo grid if said game comprises video bingo, said controller being programmed to determine a value payout associated with an outcome of said game, said controller being programmed to cause a second display portion representing an image of a rotating wheel to be generated, said rotating wheel image having a section with a symbol image disposed thereon, said section of said rotating wheel rotating angularly about an axis of said rotating wheel; and said controller being programmed to cause said symbol image to generally maintain an orientation relative to a plane perpendicular to said axis while changing its orientation relative to said section of said rotating wheel as said section of said rotating wheel rotates angularly about said axis.

2. A gaming apparatus as defined in claim 1 wherein said controller is programmed to cause said symbol image to be adjusted to generally maintain said orientation relative to said plane after said rotating wheel image rotates about said axis by a predetermined degree of rotation.

3. A gaming apparatus as defined in claim 1 wherein said controller is programmed to cause said symbol image to generally maintain a horizontal orientation relative to said plane while changing its orientation relative to said section of said rotating wheel as said section of said rotating wheel rotates angularly about said axis.

4. A gaming apparatus as defined in claim 1 wherein said controller is programmed to cause said symbol image to generally maintain an orientation that is easily readable by said player as said section of said rotating wheel rotates angularly about said axis.

5. A gaming apparatus as defined in claim 1 wherein said second display portion is generated on one of said display unit or a second display unit.

6. A gaming apparatus as defined in claim 1 wherein said symbol image comprises an alphanumeric character.

7. A gaming apparatus as defined in claim 1, wherein said controller is further programmed to determine a value payout based on a resting position of said wheel image after said wheel image has stopped rotating.

8. A gaming apparatus as defined in claim 1, wherein said controller is further programmed to cause a plurality of symbol images to be displayed on said section, wherein said plurality of symbol images represents a prize that may be won by said player.

9. A gaming apparatus as defined in claim 8, wherein said controller is further programmed to update said symbol images to represent a current prize.

10. A gaming apparatus, comprising:

a display unit that is capable of generating video images;

a value input device;

a controller operatively coupled to said display unit and said value input device, said controller comprising a processor and a memory operatively coupled to said processor, said controller being programmed to allow a person to make a wager, said controller being programmed to cause a display portion representing an image of a rotating wheel to be generated on said display unit, said rotating wheel image having a section with a symbol image disposed thereon, said section of said rotating wheel rotating angularly about an axis of said rotating wheel; and said controller being programmed to cause said symbol image to generally maintain an orientation relative to a plane perpendicular to said axis while changing its orientation relative to said section of said rotating wheel as said section of said rotating wheel rotates angularly about said axis; and said controller being programmed to determine a value payout associated with an outcome of a game incorporating said wheel image.

11. A gaming apparatus as defined in claim 10 wherein said controller is programmed to cause said symbol image to be adjusted to generally maintain said orientation relative to said plane after said rotating wheel image rotates about said axis by a predetermined degree of rotation.

12. A gaming apparatus as defined in claim 11 wherein said controller is programmed to cause said symbol image to generally maintain a horizontal orientation relative to said plane while changing its orientation relative to said section of said rotating wheel as said section of said rotating wheel rotates angularly about said axis.

13. A gaming apparatus, comprising:

a display unit that is capable of generating video images;

a value input device;

a controller operatively coupled to said display unit and said value input device, said controller comprising a processor and a memory operatively coupled to said processor, said controller being programmed to allow a person to make a wager, said controller being programmed to cause a display portion to be generated on said display unit, said display portion representing a game with an image of a rotating wheel, said rotating wheel image having a section with a symbol image disposed thereon, said section of said rotating wheel rotating angularly about an axis of said rotating wheel; and said controller being programmed to cause said symbol image to generally maintain an orientation relative to a plane perpendicular to said axis while changing its orientation relative to said section of said rotating wheel as said section of said rotating wheel rotates angularly about said axis; and said controller being programmed to determine, after said display portion has been displayed, a value payout associated with an outcome of said game represented by said display portion.

14. A gaming apparatus as defined in claim 13 wherein said controller is programmed to cause said symbol image to be adjusted to generally maintain said orientation relative to said plane after said rotating wheel image rotates about said axis by a predetermined degree of rotation.

15. A gaming apparatus as defined in claim 13 wherein said controller is programmed to cause said symbol image to generally maintain a horizontal orientation relative to said plane while changing its orientation relative to said section of said mechanically rotatable wheel as said section of said mechanically rotatable wheel rotates angularly about said axis.

16. A gaming apparatus as defined in claim 13, wherein said image of said rotating wheel further comprises a plurality of sections displayed on said wheel image, said plurality of sections each having a symbol image displayed thereon.

17. A gaming apparatus, comprising:

a value input device;

a mechanically rotatable wheel divided into a plurality of sections, at least one of said sections comprising an electronic display, said at least one of said sections rotating angularly about an axis of said mechanically rotatable wheel;

a controller operatively coupled to said mechanically rotatable wheel, said value input device, and said electronic display, said controller comprising a processor and a memory operatively coupled to said processor, said controller being programmed to allow a person to make a wager, said controller being programmed to cause a symbol image to be generated on said electronic display, said controller being programmed to cause said symbol image to generally maintain an orientation relative to a plane perpendicular to said axis while changing its orientation relative to said at least one of said sections of said mechanically rotatable wheel as said at least one of said sections of said mechanically rotatable wheel rotates angularly about said axis; and said controller being programmed to determine a value payout associated with an outcome of a game incorporating said mechanically rotatable wheel.

18. A gaming apparatus as defined in claim 17 wherein said controller is programmed to cause said symbol image to be adjusted to generally maintain said orientation relative to said plane after said mechanically rotatable wheel rotates about said axis by a predetermined degree of rotation.

19. A gaming apparatus as defined in claim 17 wherein said controller is programmed to cause said symbol image to generally maintain a horizontal orientation relative to said plane while changing its orientation relative to said at least one of said sections of said mechanically rotatable wheel as said at least one of said sections rotates angularly about said axis.

20. A gaming apparatus as defined in claim 17, wherein said controller is further programmed to cause a plurality of symbol images to be displayed on said electronic display, wherein said plurality of symbol images represent a prize that may be won by said player.

21. A gaming apparatus as defined in claim 20, wherein said controller is further programmed to update said symbol images to represent a current prize.

22. A gaming apparatus as defined in claim 17, wherein said mechanically rotatable wheel further comprises an electronic display attached to each of said plurality of sections on said mechanically rotatable wheel, said plurality of sections each having a symbol image displayed thereon.

23. A gaming apparatus, comprising:

a housing;

a transparent display portion associated with said housing;

a value input device;

a mechanically rotatable wheel having a section disposed on a first surface of said mechanically rotatable wheel, said section comprising an electronic display, said section comprising said electronic display rotating angularly about an axis of said mechanically rotatable wheel;

said mechanically rotatable wheel being disposed in said housing so that said first surface of said wheel and said electronic display are visible to a player of said gaming apparatus through said transparent display portion;

a controller operatively coupled to said mechanically rotatable wheel, said value input device, and said electronic display, said controller comprising a processor and a memory operatively coupled to said processor;

said controller being programmed to allow a person to make a wager, said controller being programmed to cause a symbol image to be generated on said electronic display, said controller being programmed to cause said symbol image to generally maintain an orientation relative to a plane perpendicular to said axis while changing its orientation relative to said section as said section rotates angularly about said axis; and said controller being programmed to determine a value payout associated with an outcome of a game associated with said mechanically rotatable wheel.

24. A gaming apparatus as defined in claim 23 wherein said controller is programmed to cause said symbol image to be adjusted to generally maintain said orientation relative to said plane after said mechanically rotatable wheel rotates about said axis by a predetermined degree of rotation.

25. A gaming apparatus as defined in claim 23 wherein said controller is programmed to cause said symbol image to generally maintain a horizontal orientation relative to said plane while changing its orientation relative to said section as said section rotates angularly about said axis.

26. A gaming apparatus as defined in claim 23, wherein said mechanically rotatable wheel further comprises a plurality of sections disposed on said first surface of said mechanically rotatable wheel, said plurality of sections each having an electronic display attached thereto and at least one symbol image displayed on each of said electronic displays.

27. A gaming apparatus, comprising:

a video display unit that is capable of generating video images, said video display unit being associated with a first game;

a value input device;

a mechanically rotatable wheel associated with a second game, said mechanically rotatable wheel having a section displayed thereon, said section comprising an electronic display, said section comprising said electronic display rotating angularly about an axis of said mechanically rotatable wheel;

a controller operatively coupled to said video display unit, said value input device, said mechanically rotatable wheel, and said electronic display, said controller comprising a processor and a memory operatively coupled to said processor, said controller being programmed to allow a person to make a wager, said controller being programmed to cause a display portion representing a first game to be generated on said video display unit, said display portion representing one of the following first games: video poker, video blackjack, video slots, video keno or video bingo, said display portion comprising an image of at least five playing cards if said first game comprises video poker, said display portion comprising an image of a plurality of simulated slot machine reels if said first game comprises video slots, said display portion comprising an image of a plurality of playing cards if said first game comprises video blackjack, said display portion comprising an image of a plurality of keno numbers if said first game comprises video keno, said display portion comprising an image of a bingo grid if said first game comprises video bingo, and said controller being programmed to determine a value payout associated with an outcome of said first game, said controller being programmed to cause a symbol image to be generated on said electronic display, said controller being programmed to cause said symbol image to generally maintain an orientation relative to a plane perpendicular to said axis while changing its orientation relative to said section as said section rotates angularly about said axis; and said controller being programmed to determine a value payout associated with an outcome of said second game.

28. A gaming apparatus as defined in claim 27 wherein said controller is programmed to cause said symbol image to be adjusted to generally maintain said orientation relative to said plane after said mechanically rotatable wheel rotates about said axis by a predetermined degree of rotation.

29. A gaming apparatus as defined in claim 27 wherein said controller is programmed to cause said symbol image to generally maintain a horizontal orientation relative to said plane while changing its orientation relative to said section as said section rotates angularly about said axis.

30. A method of displaying a symbol on a wheel in a gaming apparatus comprising:

causing said wheel to rotate about an axis;

displaying said symbol on said rotating wheel;

generally maintaining an orientation of said symbol relative to a plane perpendicular to said axis while changing said symbol's orientation relative to said wheel as said wheel rotates angularly about said axis; and determining a value payout associated with an outcome of a game corresponding to said rotating wheel.

31. A gaming method as defined in claim 30, comprising adjusting said orientation of said symbol to maintain said orientation relative to said plane after said wheel rotates past a predetermined threshold.

32. A gaming method as defined in claim 30, comprising displaying said symbol on a spectrum display attached to said rotating wheel.

33. A gaming method as defined in claim 30, comprising displaying a video image of said symbol and said rotating wheel on a video display unit.

34. A gaming method as defined in claim 30, further comprising updating said symbol to display a current value of a jackpot.

35. A gaming method as defined in claim 30, further comprising displaying a plurality of sections on said wheel, each of said sections having an electronic display attached thereto and at least one symbol displayed on each of said electronic displays.

* * * * *